US011885518B2

(12) United States Patent
Fukui et al.

(10) Patent No.: US 11,885,518 B2
(45) Date of Patent: Jan. 30, 2024

(54) AIR-CONDITIONING APPARATUS

(71) Applicant: MITSUBISHI ELECTRIC CORPORATION, Tokyo (JP)

(72) Inventors: Koji Fukui, Tokyo (JP); Kosuke Tanaka, Tokyo (JP); Kazuya Watanabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 500 days.

(21) Appl. No.: 17/277,330

(22) PCT Filed: Dec. 11, 2018

(86) PCT No.: PCT/JP2018/045518
§ 371 (c)(1),
(2) Date: Mar. 18, 2021

(87) PCT Pub. No.: WO2020/121411
PCT Pub. Date: Jun. 18, 2020

(65) Prior Publication Data
US 2021/0348789 A1 Nov. 11, 2021

(51) Int. Cl.
*F24F 11/42* (2018.01)
*F24F 11/67* (2018.01)
(Continued)

(52) U.S. Cl.
CPC ..... *F24F 11/42* (2018.01); *F24F 1/16* (2013.01); *F24F 11/67* (2018.01); *F25B 47/022* (2013.01);
(Continued)

(58) Field of Classification Search
CPC .... F25B 2313/02332; F25B 2313/0243; F25B 2313/0251; F25B 2313/02522; F25B 2313/0253; F24F 11/42; F24F 11/67
See application file for complete search history.

(56) References Cited

U.S. PATENT DOCUMENTS 4,332,137 A * 6/1982 Hayes, Jr. ..... F25B 47/022 62/81
4,678,025 A * 7/1987 Oberlander ..... F24F 1/022 165/59
(Continued)

FOREIGN PATENT DOCUMENTS

CN 104520656 A 4/2015
CN 107110547 A 8/2017
(Continued)

OTHER PUBLICATIONS

Office Action dated May 7, 2023 issued in corresponding CN Patent Application No. 202210719088.7 (and English machine translation).
(Continued)

*Primary Examiner* — Travis Ruby
*Assistant Examiner* — Christopher C Pillow
(74) *Attorney, Agent, or Firm* — POSZ LAW GROUP, PLC

(57) ABSTRACT

An air-conditioning apparatus includes a refrigerant circuit, an air-conditioning load state detection unit, an operation-state detection unit, and a controller. The refrigerant circuit includes a main circuit and a bypass circuit. The air-conditioning apparatus has a simultaneous heating and defrosting operation mode. In the simultaneous heating and defrosting operation mode, the controller controls a compressor, a pressure reducing device, and a defrosting refrigerant pressure-reducing device such that control amounts of the compressor, the pressure reducing device, and the defrosting refrigerant pressure-reducing device reach respective normal-time control target values that are set based on an air-conditioning load state and an operation state.

13 Claims, 5 Drawing Sheets

(51) Int. Cl.
*F24F 1/16* (2011.01)
*F25B 47/02* (2006.01)
*F24F 1/32* (2011.01)

(52) U.S. Cl.
CPC ..... *F24F 1/32* (2013.01); *F25B 2313/0251* (2013.01); *F25B 2313/0253* (2013.01); *F25B 2313/02522* (2013.01); *F25B 2313/02531* (2013.01); *F25B 2313/02532* (2013.01); *F25B 2313/02533* (2013.01); *F25B 2313/0314* (2013.01); *F25B 2313/0315* (2013.01); *F25B 2347/021* (2013.01)

(56) References Cited

U.S. PATENT DOCUMENTS 5,142,879 A * 9/1992 Nakamura ..... F25B 13/00 62/211
5,467,604 A * 11/1995 Sekigami ..... F24F 3/065 62/175
5,526,649 A * 6/1996 Sada ..... F24F 3/065 62/196.2
5,771,699 A * 6/1998 Ponder ..... F24F 11/30 62/81
6,276,158 B1 * 8/2001 Lowes ..... F25B 41/34 62/324.1
10,001,317 B2 * 6/2018 Takenaka ..... F25B 13/00
2002/0162348 A1 * 11/2002 Lowes ..... F25B 40/00 62/160
2004/0216480 A1 * 11/2004 Jang ..... F25B 47/022 62/278
2004/0226711 A1 * 11/2004 Jang ..... F25B 13/00 165/231
2005/0044861 A1 * 3/2005 Cho ..... F25B 13/00 62/81
2006/0137381 A1 * 6/2006 Choi ..... F25B 13/00 62/324.1
2009/0056358 A1 * 3/2009 Kotani ..... F24F 5/0017 62/259.1
2010/0170270 A1 * 7/2010 Jang ..... F25B 13/00 62/81
2011/0232308 A1 * 9/2011 Morimoto ..... F25B 13/00 62/278
2012/0266616 A1 * 10/2012 Lee ..... F25B 47/02 62/275
2013/0104576 A1 * 5/2013 Lee ..... F25B 47/022 62/272
2013/0145785 A1 * 6/2013 Nobuhiro ..... F25B 47/025 62/160
2014/0116078 A1 * 5/2014 Doumyou ..... F25B 47/022 62/238.6
2014/0245766 A1 * 9/2014 Wakamoto ..... F25B 47/022 62/151
2015/0292756 A1 10/2015 Takenaka et al.
2015/0292789 A1 * 10/2015 Takenaka ..... F25D 21/006 62/140
2016/0116202 A1 * 4/2016 Takenaka ..... F25D 21/002 62/140
2016/0273795 A1 * 9/2016 Takenaka ..... F24F 13/30
2016/0370045 A1 * 12/2016 Takenaka ..... F28D 1/0443
2017/0108249 A1 * 4/2017 Morishita ..... F25B 9/008
2017/0153050 A1 * 6/2017 Nakagawa ..... F25B 47/025
2017/0198955 A1 * 7/2017 Minami ..... F25B 47/02
2017/0370627 A1 12/2017 Takenaka et al.
2018/0231287 A1 * 8/2018 Tanaka ..... F25B 41/00
2018/0328636 A1 * 11/2018 Ohura ..... F25B 47/025
2019/0032978 A1 * 1/2019 Ohura ..... F25B 47/02

FOREIGN PATENT DOCUMENTS

JP S54-134851 A 10/1979
JP 2009-085484 A 4/2009

OTHER PUBLICATIONS

International Search Report dated Feb. 26, 2019, issued in corresponding International Application No. PCT/JP2018/045518.

* cited by examiner

AIR-CONDITIONING APPARATUS

CROSS REFERENCE TO RELATED APPLICATION

This application is a U.S. National Stage Application of International Application No. PCT/JP2018/045518, filed on Jun. 18, 2020, the contents of which are incorporated herein by reference.

TECHNICAL FIELD

The present disclosure relates to an air-conditioning apparatus having a simultaneous heating and defrosting operation mode in which a heating operation and a defrosting operation are performed simultaneously.

BACKGROUND ART

In the past, air-conditioning apparatuses having a simultaneous heating and defrosting operation mode have been proposed. In the simultaneous heating and defrosting operation mode of such an air-conditioning apparatus, divided heat exchanger portions of an outdoor heat exchanger are alternately defrosted (see, for example, Patent Literatures 1 and 2). To be more specific, in this technique, the outdoor heat exchanger that operates as an evaporator during a heating operation is divided into the heat exchanger portions. Furthermore, a bypass circuit and an electromagnetic opening/closing valve are provided. The bypass circuit bypasses gas discharged from a compressor in association with each of the heat exchanger portions. The electromagnetic opening/closing valve controls a bypassed state.

In such an existing technique as described above, during the heating operation of the air-conditioning apparatus, the divided heat exchange portions are alternately subjected to a defrosting operation without reversing a refrigeration cycle, thus achieving a nonstop heating operation.

CITATION LIST

Patent Literature

Patent Literature 1: Japanese Unexamined Patent Application Publication No. 2009-085484

Patent Literature 2: Japanese Unexamined Patent Application Publication No. Sho 54-134851

SUMMARY OF INVENTION

Technical Problem

In the above existing technique, in the case of performing a simultaneous heating and defrosting operation in which the divided heat exchange portions are alternately defrosted while a heating operation is continued, the state of the refrigeration cycle greatly changes when the operation mode is switched from the heating operation mode to the simultaneous heating and defrosting operation mode. However, a control operation for controlling actuators included in a refrigerant circuit cannot be performed depending on the change of the state of refrigerant. As a result, in the simultaneous heating and defrosting operation mode, a heating capacity is reduced, and a room temperature is reduced because of a decrease in the temperature of air blown out from the indoor heat exchanger that performs the heating operation, thus impairing the comfort. In contrast, in the simultaneous heating and defrosting operation mode, when the heating capacity is forcibly increased, a defrosting capacity cannot be ensured, thus reducing the reliability.

The present disclosure is applied to solve the above problem, and relates to an air-conditioning apparatus that can, in a simultaneous heating and defrosting operation mode, maintain the comfort by maintaining a heating capacity before and after the operation mode is switched from a heating operation mode to the simultaneous heating and defrosting operation mode, and at the same time can ensure reliability by ensuring an appropriate defrosting capacity in the simultaneous heating and defrosting operation mode.

Solution to Problem

An air-conditioning apparatus according to an embodiment of the present disclosure includes: a refrigerant circuit including a main circuit and a bypass circuit; an air-conditioning load state detection unit: an operation-state detection unit; and a controller. In the main circuit, a compressor, a cooling/heating switching device, an indoor heat exchanger, a pressure reducing device, and parallel outdoor heat exchangers are connected by refrigerant pipes. The bypass circuit is connected, by a pipe, to each of the parallel outdoor heat exchangers via a defrosting refrigerant pressure-reducing device, a defrosting flow passage switching device, and a backflow prevention device. The defrosting refrigerant pressure-reducing device reduces the pressure of refrigerant that branches off from the main circuit, by adjusting the flow rate of the refrigerant in a refrigerant pipe that branches off from a discharge pipe at the compressor. The defrosting flow passage switching device switches a flow passage for refrigerant that is supplied to one of the parallel outdoor heat exchangers. The backflow prevention device is provided between the defrosting flow passage switching device and the cooling/heating switching device to prevent backflow of low-pressure refrigerant that flows to a suction side of the compressor. The bypass circuit is provided to: cause part of refrigerant discharged from the compressor to branch off from the discharged refrigerant; switch a flow passage for use in introduction of refrigerant, using the defrosting flow passage switching device, to select one of the parallel outdoor heat exchangers as a defrosting target to be defrosted; and supply defrosting refrigerant whose pressure is reduced by the defrosting refrigerant pressure-reducing device to the defrosting target. The air-conditioning load state detection unit detects an air-conditioning load state. The operation-state detection unit detects an operation state of the refrigerant circuit. The controller individually controls operations of the compressor, the pressure reducing device, the defrosting refrigerant pressure-reducing device, and the defrosting flow passage switching device. The air-conditioning apparatus has a simultaneous heating and defrosting operation mode in which a heating operation and a defrosting operation are simultaneously performed such that while the heating operation is continued on an indoor side, the defrosting refrigerant is made to flow in the bypass circuit on an outdoor side to alternately defrost the parallel outdoor heat exchangers. In the simultaneous heating and defrosting operation mode, the controller controls the compressor, the pressure reducing device, and the defrosting refrigerant pressure-reducing device such that control amounts of the compressor, the pressure reducing device, and the defrosting refrigerant pressure-reducing device reach respective normal-time control target values set based on the air-conditioning load state and the operation state.

Advantageous Effects of Invention

In the air-conditioning apparatus according to the embodiment of the present disclosure, in the simultaneous heating and defrosting operation mode, the controller controls the compressor, the pressure reducing device, and the defrosting refrigerant pressure-reducing device such that control amount of the compressor, the pressure reducing device, and the defrosting refrigerant pressure-reducing device to the respective set-time control target values set based on the air-conditioning load state and the operation state. With such a configuration, it is possible to achieve a simultaneous heating and defrosting operation mode that uses a feedback control that is based on the air-conditioning load state and the operation state. Thus, in the simultaneous heating and defrosting operation mode, it is possible to maintain the comfort by maintaining heating capacity before and after switching the operation mode from the heating operation mode to the simultaneous heating and defrosting operation mode and at the same time ensure reliability by ensuring an appropriate defrosting capacity in the simultaneous heating and defrosting operation mode.

DESCRIPTION OF EMBODIMENTS

An embodiment of the present disclosure will be described with reference to the above figures. In each of the figures, components that are the same as or equivalent to those in a previous figure or figures are denoted by the same reference signs. The same is true of the entire text of the specification. Of the figures, in a sectional view, hatching is omitted in view of viewability. Furthermore, in the entire text of the specification, configurations of components will be described by way of example, and the configurations of the components are not limited to the configurations described in the entire text.

Embodiment 1

<Configurations of Components of Air-Conditioning Apparatus>

Figure 1:
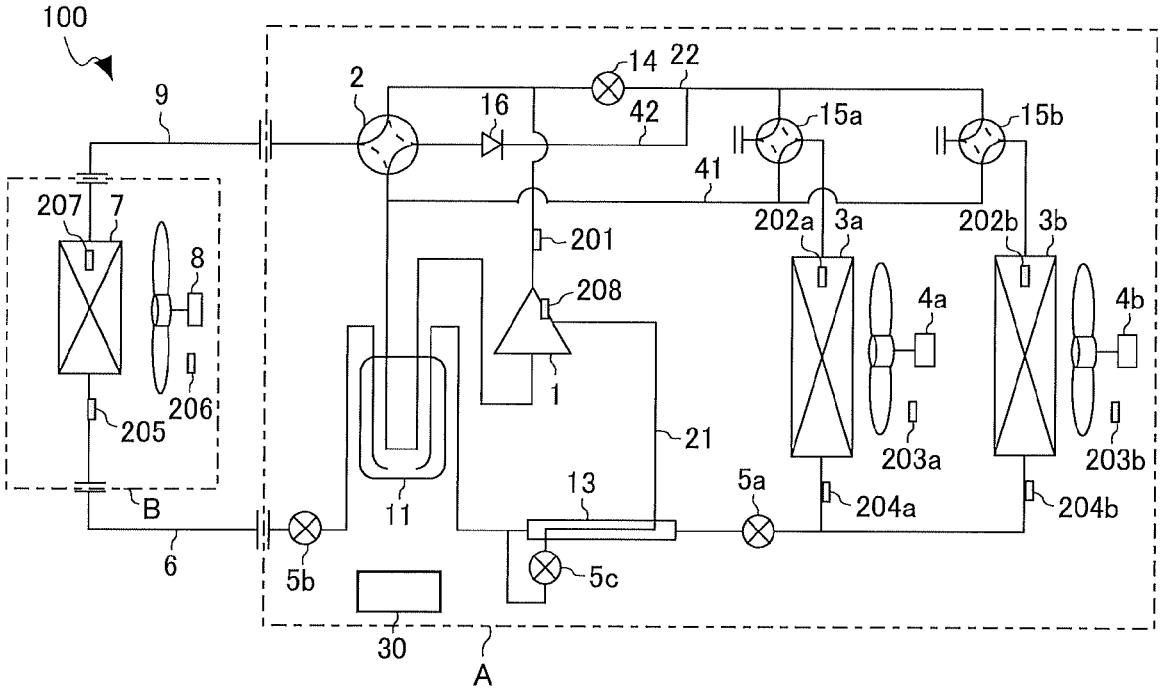
FIG. 1 is a configuration diagram illustrating a refrigerant circuit of an air-conditioning apparatus according to Embodiment 1 of the present disclosure.

FIG. 1 is a configuration diagram illustrating a refrigerant circuit of an air-conditioning apparatus 100 according to Embodiment 1 of the present disclosure. As illustrated in FIG. 1, the air-conditioning apparatus 100 is an apparatus that cools and heats an indoor space by performing a vapor compression refrigeration cycle operation. The air-conditioning apparatus 100 includes a heat source unit A and one or more use units B connected to the heat source unit A by a liquid connection pipe 6 and a gas connection pipe 9 that serve as refrigerant communication pipes, such that the use unit or units B and the heat source unit A are arranges side by side. Regarding Embodiment 1, it is illustrated by way of example that a single use unit B is provided.

As refrigerant for use in the air-conditioning apparatus 100, an HFC refrigerant such as R410A, R407C, R404A or R32, an HFO refrigerant such as R1234yf/ze, a mixed refrigerant of these refrigerants, or a natural refrigerant such as carbon dioxide ($CO_2$), hydrocarbon, helium, or propane is used.

<Use Unit B>

The use unit B is embedded in a ceiling of a room, hung from the ceiling, or attached to a wall surface of the room. The use unit B is connected to the heat source unit A by the liquid connection pipe 6 and the gas connection pipe 9, thus forming part of the refrigerant circuit.

The use unit B forms an indoor-side refrigerant circuit that is part of the refrigerant circuit. The use unit B includes an indoor fan 8 and an indoor heat exchanger 7 that is a use-side heat exchanger.

The indoor heat exchanger 7 is a cross-fin fin-and-tube heat exchanger including heat transfer tubes and a large number of fins. During a cooling operation, the indoor heat exchanger 7 operates as an evaporator for refrigerant to cool indoor air. During a heating operation, the indoor heat exchanger 7 operates as a condenser for refrigerant to heat indoor air.

The indoor fan 8 is a fan that can change the flow rate of air that is supplied to the indoor heat exchanger 7. The indoor fan 8 is, for example, a centrifugal fan or a multi-blade fan that is driven by a DC motor (not illustrated). The indoor fan 8 sucks indoor air into the use unit B, and supplies air that is subjected to heat exchange with refrigerant at the indoor heat exchanger 7, into an indoor space as conditioned air.

In the use unit B, various kinds of sensors are provided. To be more specific, a liquid-side temperature sensor 205 is provided at liquid-side part of the indoor heat exchanger 7. The liquid-side temperature sensor 205 detects a subcooled liquid temperature Tco during the heating operation, which is the temperature of liquid refrigerant or two-phase gas-liquid refrigerant, or a refrigerant temperature that corresponds to an evaporating temperature Te during the cooling operation. The indoor heat exchanger 7 is provided with a gas-side temperature sensor 207 that detects a condensing temperature Tc during the heating operation, which is the temperature of two-phase gas-liquid refrigerant, or a refrigerant temperature that corresponds to the evaporating temperature Te during the cooling operation. An indoor temperature sensor 206 is provided on an indoor-air suction-port side of the use unit B. The indoor temperature sensor 206 detects the temperature of indoor air that flows into the use unit B. In Embodiment 1, each of the liquid-side temperature sensor 205, the gas-side temperature sensor 207, and the indoor temperature sensor 206 is a thermistor. The operation of the indoor fan 8 is controlled by a controller 30 that is an operation control unit.

<Heat Source Unit A>

The heat source unit A is installed in outdoor space. The heat source unit A is connected to the use unit B by the liquid connection pipe 6 and the gas connection pipe 9, thus forming part of the refrigerant circuit.

The heat source unit A includes a compressor 1, a cooling/heating switching device 2, a first parallel outdoor heat exchanger 3*a*, a second parallel outdoor heat exchanger 3*b*, a first outdoor fan 4*a*, a second outdoor fan 4*b*, a pressure reducing device 5*a*, a pressure reducing device 5*b*, an injection refrigerant pressure-reducing device 5*c*, a receiver 11, and an internal heat exchanger 13. The first parallel outdoor heat exchanger 3*a* and the second parallel outdoor heat exchanger 3*b* are included in an outdoor heat exchanger 3 that is a heat-source-side heat exchange These components are provided in the main circuit of the refrigerant circuit of the heat source unit A.

The heat source unit A includes a defrosting refrigerant pressure-reducing device 14, a defrosting flow passage switching device 15, a defrosting flow passage switching device 15*b*, and a backflow prevention device 16. These components are provided in a bypass circuit in the refrigerant circuit of the heat source unit A.

The compressor 1 is a compressor that can change an operation capacity, such as a frequency, and in the following example, the compressor 1 is a positive-displacement compressor that is controlled by an inverter, and is driven by a motor (not illustrated). The compressor 1 has a port that enables injection for introduction of refrigerant to be performed in an intermediate part of a compression process in a compression chamber. For example, when liquid refrigerant or liquid-gas refrigerant is injected at a predetermined injection pressure, a discharge temperature can be prevented from being excessively raised. In this example, only one compressor 1 is used; however, the number of compressors 1 is not limited to one. Two or more compressors 1 may be connected to each other depending on the number of use units B, such that the compressors 1 are arranged side by side.

The cooling/heating switching device 2 is a valve that switches the flow direction of refrigerant between a plurality of flow directions. During the cooling operation, the cooling/heating switching device 2 causes the first parallel outdoor heat exchanger 3*a* and the second parallel outdoor heat exchanger 3*b* to operate as condensers for refrigerant that is compressed by the compressor 1, and causes the indoor heat exchanger 7 to operate as an evaporator for refrigerant that is condensed at the first parallel outdoor heat exchanger 3*a* and the second parallel outdoor heat exchanger 3*b*. Therefore, the cooling/heating switching device 2 switches the refrigerant flow passage such that a discharge side of the compressor 1 is connected with gas-side part of the first parallel outdoor heat exchanger 3*a* and a gas-side part of the second parallel outdoor heat exchanger 3*b*, and a suction side of the compressor 1 is connected with the gas connection pipe 9. In this case, referring to FIG. 1, the cooling/heating switching device 2 is in a state indicated by broken lines.

During the heating operation, the cooling/heating switching device 2 causes the indoor heat exchanger 7 to operate as a condenser for refrigerant that is compressed by the compressor 1, and causes the first parallel outdoor heat exchanger 3*a* and the second parallel outdoor heat exchanger 3*b* to operate as evaporators for refrigerant that is condensed by the indoor heat exchanger 7. Therefore, the cooling/heating switching device 2 switches the refrigerant flow passage such that the discharge side of the compressor 1 is connected with the gas connection pipe 9, and the suction side of the compressor 1 is connected with the gas side of the first parallel outdoor heat exchanger 3*a* and the gas side of the second parallel outdoor heat exchanger 3*b*. In this case, referring to FIG. 1, the cooling/heating switching device 2 is in a state indicated by solid lines.

Figure 2:
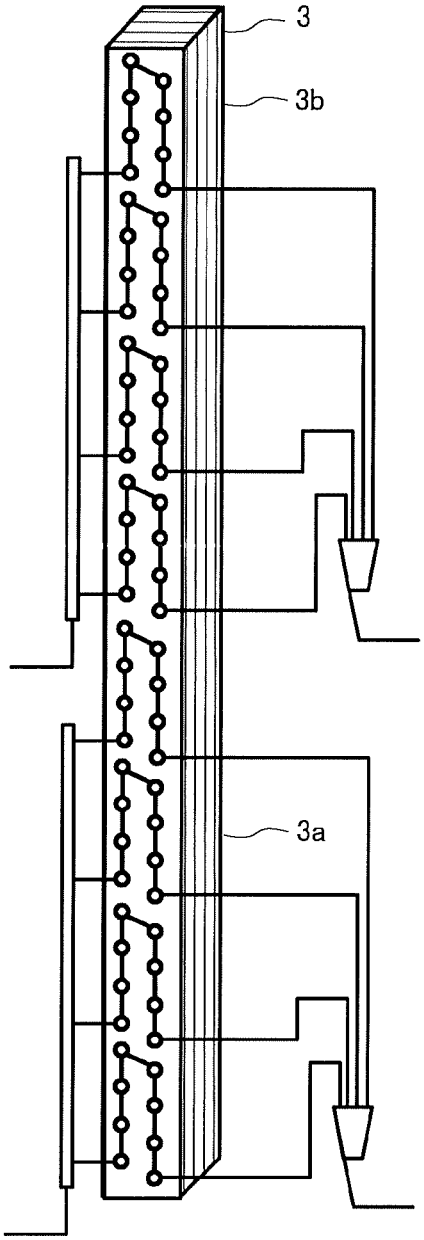
FIG. 2 is a configuration diagram illustrating an outdoor heat exchanger of the air-conditioning apparatus according to Embodiment 1 of the present disclosure.

FIG. 2 is a configuration diagram illustrating the outdoor heat exchanger 3 of the air-conditioning apparatus 100 according to Embodiment 1 of the present disclosure. As illustrated in FIG. 2, the outdoor heat exchanger 3 is a cross-fin fin-and-tube heat exchanger that includes, for example, heat transfer tubes and a large number of fins. The outdoor heat exchanger 3 operates as a condenser for refrigerant during the cooling operation, and operates as an evaporator for refrigerant during the heating operation. The outdoor heat exchanger 3 is divided into a plurality of parallel heat exchangers. In Embodiment 1, the outdoor heat exchanger 3 is divided into two parallel outdoor heat exchangers, that is, in this example, the outdoor heat exchanger is divided into the first parallel outdoor heat exchanger 3*a* and the second parallel outdoor heat exchanger 3*b*.

The first parallel outdoor heat exchanger 3*a* and the second parallel outdoor heat exchanger 3*b* are formed by dividing the outdoor heat exchanger 3 that extends in a vertical direction in a housing of the heat source unit A. The outdoor heat exchanger 3 may be divided in a lateral direction. However, in the case where the outdoor heat exchanger 3 is divided in the lateral direction, refrigerant inlets of the parallel heat exchangers are located at left and right ends, as a result of which pipes are connected complicatedly. It is therefore preferable that the outdoor heat exchanger 3 be divided in the vertical direction. Therefore, the outdoor heat exchanger 3 is housed in the housing of the heat source unit A such that the first parallel outdoor heat exchanger 3*a* and the second parallel outdoor heat exchanger 3*b* are mounted in the vertical direction.

As illustrated in FIG. 1, each of the first outdoor fan 4*a* and the second outdoor fan 4*b* is a fan that can change the flow rate of air that is supplied to the outdoor heat exchanger 3. For example, each of the first outdoor fan 4*a* and the second outdoor fan 4*b* is a propeller fan that is driven by a DC motor (not illustrated). Each of the first outdoor fan 4*a* and the second outdoor fan 4*b* sucks outdoor air into the heat source unit A, and discharges to the outdoor space, air subjected to heat exchange with refrigerant at the outdoor heat exchanger 3. In this example, two outdoor fans, that is, the first outdoor fan 4*a* and the second outdoor fan 4*b*, are used. The first outdoor fan 4*a* and the second outdoor fan 4*b* are provided in the housing of the heat source unit A to send outdoor air to the first parallel outdoor heat exchanger 3*a* and the second parallel outdoor heat exchanger 3*b*, respectively.

The receiver 11 is a refrigerant container that stores liquid refrigerant. The receiver 11 has both a gas-liquid separation function and a function of storing liquid refrigerant that remains as surplus liquid refrigerant during the operation of the refrigeration cycle. In the receiver 11, an internal heat exchanger (not illustrated) is provided. The internal heat exchanger is configured such that refrigerant pipes are connected to cause heat exchange to be performed between liquid refrigerant stored in the receiver 11 and refrigerant that circulates through the gas connection pipe 9 that connects the cooling/heating switching device 2 with the suction portion of the compressor 1.

Each of the pressure reducing device 5*a* and the pressure reducing device 5*b* adjusts the flow rate of refrigerant that flows in the refrigerant circuit, to thereby reduce the pressure of the refrigerant. The pressure reducing device 5*a* and the pressure reducing device 5*b* are connected to the liquid-side part of the heat source unit A. The receiver 11 is provided in a refrigerant flow passage that connects the pressure reducing device 5*a* and the pressure reducing device 5*b*.

As described above, in the heat source unit A, a main circuit is provided in which the compressor 1, the cooling/heating switching device 2, the pressure reducing device 5*a*, the pressure reducing device 5*b*, the first parallel outdoor heat exchanger 3*a*, and the second parallel outdoor heat exchanger 3*b* are connected by refrigerant pipes. This main circuit also includes the indoor heat exchanger 7 of the use unit B as a component, and the indoor heat exchanger 7 is also connected by a refrigerant pipe.

In the refrigerant circuit, a first bypass pipe 21 is provided to form an injection flow passage for injecting into the compressor 1, part of refrigerant that is present in the refrigerant flow passage between the pressure reducing device 5*a* and the pressure reducing device 5*b*. That is, the main circuit includes the first bypass pipe 21 that branches off from the refrigerant pipe that extends from the compressor 1 through the indoor heat exchanger 7 to inject refrigerant that branches off from the main circuit into the compressor 1.

One of ends of the first bypass pipe 21 is provided in such a manner as to branch off from part of the refrigerant pipe between the pressure reducing device 5*a* and the pressure reducing device 5*b*. The other end of the first bypass pipe 21 is connected with an injection port that communicates with a compression chamber of the compressor 1 that is located in the middle of compression via the internal heat exchanger 13. The injection refrigerant pressure-reducing device 5*c* is provided at an intermediate portion of the first bypass pipe 21. The injection refrigerant pressure-reducing device 5*c* adjusts the flow rate of refrigerant that flows through the first bypass pipe 21, to thereby reduce the pressure of the refrigerant. The injection refrigerant pressure-reducing device 5*c* includes a solenoid valve and a capillary tube such as a capillary, for example, and adjusts the flow rate of refrigerant that flows through the first bypass pipe 21, by an opening/closing operation of the solenoid valve that is performed by turning on/off the solenoid valve.

In the refrigerant circuit, a second bypass pipe 22 is provided to supply part of refrigerant discharged from the compressor 1 to the outdoor heat exchanger 3. One of ends of the second bypass pipe 22 is provided in such a manner as to branch off from part of the refrigerant pipe between the compressor 1 and the cooling/heating switching device 2. The other end of the second bypass pipe 22 is connected to refrigerant pipes at the gas-side parts of the divided outdoor heat exchangers 3, that is, to the refrigerant pipe at the gas-side part of the first parallel outdoor heat exchanger 3*a* and to the refrigerant pipe at the gas-side part of the second parallel outdoor heat exchanger 3*b*.

At the second bypass pipe 22, the defrosting refrigerant pressure-reducing device 14 is provided to adjust the flow rate of refrigerant that flows through the second bypass pipe 22, to thereby reduce the pressure of the refrigerant. A refrigerant pipe on a high-pressure side of the defrosting flow passage switching device 15*a* and a refrigerant pipe on a high-pressure side of the defrosting flow passage switching device 15*b* are connected to the second bypass pipe 22 at positions upstream of the refrigerant pipe at the gas-side part of the first parallel outdoor heat exchanger 3*a* and the refrigerant pipe at the gas-side part of the second parallel outdoor heat exchanger 3*b*. The refrigerant pipe on a low-pressure side of the defrosting flow passage switching device 15*a* and the refrigerant pipe on a low-pressure side of the defrosting flow passage switching device 15*b* are connected to the refrigerant pipe between the cooling/heating switching device 2 and the receiver 11 via a first connection pipe 41.

Each of the defrosting flow passage switching device 15*a* and the defrosting flow passage switching device 15*b* is a valve that switches the flow direction of refrigerant. During the cooling operation, the defrosting flow passage switching device 15*a* causes the first parallel outdoor heat exchanger 3*a* to operate as a condenser for refrigerant that is compressed by the compressor 1, and the defrosting flow passage switching device 15*b* causes the second parallel outdoor heat exchanger 3*b* to operate as a condenser for refrigerant that is compressed by the compressor 1. Therefore, the defrosting flow passage switching device 15*a* switches the refrigerant flow passage such that the discharge side of the compressor 1 is connected with the gas-side part of the first parallel outdoor heat exchanger 3*a*. The defrosting flow passage switching device 15*b* switches the refrigerant flow passage such that the discharge-side portion of the compressor 1 is connected with the gas side of the second parallel outdoor heat exchanger 3*b*. In this case, referring to FIG. 1, the defrosting flow passage switching device 15*a* and the defrosting flow passage switching device 15*b* are in a state indicated by broken lines.

During the heating operation, the defrosting flow passage switching device 15*a* causes the first parallel outdoor heat exchanger 3*a* to operate as an evaporator for refrigerant that is condensed by the indoor heat exchanger 7, and the defrosting flow passage switching device 15*b* causes the second parallel outdoor heat exchanger 3*b* to operate as an evaporator for refrigerant that is condensed by the indoor heat exchanger 7. Therefore, the defrosting flow passage switching device 15*a* switches the refrigerant flow passages such that the suction side of the compressor 1 is connected with the gas-side part of the first parallel outdoor heat exchanger 3*a*. The defrosting flow passage switching device 15*b* switches the refrigerant flow passages such that the suction side of the compressor 1 is connected with the gas-side part of the second parallel outdoor heat exchanger 3*b*. In this case, referring to FIG. 1, the defrosting flow passage switching device 15*a* and the defrosting flow passage switching device 15*b* illustrated in FIG. 1 are in a state indicated by solid lines.

The way of using a common four-way valve, for example, the cooling/heating switching device 2, is different from that of using the defrosting flow passage switching device 15*a* and the defrosting flow passage switching device 15*b*. Each of the defrosting flow passage switching device 15*a* and the defrosting flow passage switching device 15*b* is used, with one of four flow passage ports closed, that is, the defrosting flow passage switching device 15*a* and the defrosting flow passage switching device 15*b* are each used as a three-way valve. For example, in each of the defrosting flow passage switching device 15*a* and the defrosting flow passage switching device 15*b* as illustrated in FIG. 1, the left one of the four flow passage ports is closed.

In the refrigerant circuit, a second connection pipe 42 is provided to connect the cooling/heating switching device 2 with the second bypass pipe 22. At the second connection pipe 42, the backflow prevention device 16 is provided. Because of the provision of the backflow prevention device 16, it is possible to prevent backflow in which low-pressure refrigerant flows into the second bypass pipe 22 via the cooling/heating switching device 2.

As described above, the defrosting refrigerant pressure-reducing device 14 adjusts in a refrigerant pipe that branches off from the discharge pipe at the compressor 1, the flow rate of refrigerant that branches off from the main circuit to reduce the pressure of the refrigerant. The defrosting flow passage switching device 15*a* and the defrosting flow passage switching device 15*b* switch the respective flow passages for refrigerant to be supplied to the first parallel outdoor heat exchanger 3*a* and the second parallel outdoor heat exchanger 3*b*, respectively. The backflow prevention device 16 is provided at a refrigerant pipe between each of the defrosting flow passage switching device 15*a* and the defrosting flow passage switching device 15*b* and the cooling/heating switching device 2 to prevent backflow of low-pressure refrigerant that flows to the suction side of the compressor 1. The defrosting refrigerant pressure-reducing device 14, the defrosting flow passage switching device 15*a*, the defrosting flow passage switching device 15*b*, and the backflow prevention device 16 are provided in the bypass circuit in the refrigerant circuit.

In the bypass circuit, the defrosting refrigerant pressure-reducing device 14, the defrosting flow passage switching device 15*a*, the defrosting flow passage switching device 15*b*, and the backflow prevention device 16 are connected by pipes to the first parallel outdoor heat exchanger 3*a* and the second parallel outdoor heat exchanger 3*b*, thus causing part of refrigerant discharged from the compressor 1 to branch off from the discharged refrigerant. In the bypass circuit, either the defrosting flow passage switching device 15*a* or the defrosting flow passage switching device 15*b* switches the flow passage through which refrigerant is made to flow, thereby selecting one of the first parallel outdoor heat exchanger 3*a* and the second parallel outdoor heat exchanger 3*b* as a defrosting target that is an outdoor heat exchanger to be defrosted. In the bypass circuit, defrosting refrigerant the pressure of which is reduced by the defrosting refrigerant pressure-reducing device 14 is supplied to the first parallel outdoor heat exchanger 3*a* or the second parallel outdoor heat exchanger 3*b* that is selected as the defrosting target.

In the heat source unit A, various kinds of sensors are provided. To be more specific, at the compressor 1, a discharge temperature sensor 201 is provided to detect a discharge temperature Td. The first parallel outdoor heat exchanger 3*a* and the second parallel outdoor heat exchanger 3*b* are provided with a gas-side temperature sensor 202*a* and a gas-side temperature sensor 202*b*, respectively. Each of the gas-side temperature sensor 202*a* and the gas-side temperature sensor 202*b* detects a refrigerant temperature that corresponds to a condensing temperature Tc during the cooling operation or a refrigerant temperature that corresponds to the evaporating temperature Te during the heating operation, the condensing temperature Tc being the temperature of two-phase gas-liquid refrigerant. Furthermore, a liquid-side temperature sensor 204*a* and a liquid-side temperature sensor 204*b* are respectively provided close to the liquid-side part of the first parallel outdoor heat exchanger 3*a* and close to the liquid-side part of the second parallel outdoor heat exchanger 3*b*. Each of the liquid-side temperature sensor 204*a* and the liquid-side temperature sensor 204*b* detects the temperature of liquid refrigerant or two-phase gas-liquid refrigerant. In addition, an outside air temperature sensor 203*a* and an outside air temperature sensor 203*b* are provided on an outdoor-air suction port side of the heat source unit A. The outside air temperature sensor 203*a* and the outside air temperature sensor 203*b* operate as outside-air temperature detection units each of which detects the temperature of outdoor air that flows into the housing, that is, an outside air temperature Ta.

The gas-side temperature sensor 202*a*, the outside air temperature sensor 203*a*, and the liquid-side temperature sensor 204*a* are provided in association with the first parallel outdoor heat exchanger 3*a* that is one of the divided parallel outdoor heat exchangers. The gas-side temperature sensor 202*b*, the outside air temperature sensor 203*b*, and the liquid-side temperature sensor 204*b* are provided in association with the second parallel outdoor heat exchanger 3*b* that is the other of the divided parallel outdoor heat exchangers. Each of the discharge temperature sensor 201, the gas-side temperature sensor 202*a*, the gas-side temperature sensor 202*b*, the outside air temperature sensor 203*a*, the outside air temperature sensor 203*b*, the liquid-side temperature sensor 204*a*, and the liquid-side temperature sensor 204*b* is a thermistor.

The operations of mechanical components in the compressor 1, the cooling/heating switching device 2, the first outdoor fan 4*a*, the second outdoor fan 4*b*, the pressure reducing device 5*a*, the pressure reducing device 5*b*, the injection refrigerant pressure-reducing device 5*c*, the defrosting refrigerant pressure-reducing device 14, the defrosting flow passage switching device 15*a*, and the defrosting flow passage switching device 15*b* are controlled by the controller 30 that is an operation control unit.

The injection refrigerant pressure-reducing device 5*c* includes, for example, a solenoid valve and a capillary tube. The injection refrigerant pressure-reducing device 5*c* is caused to adjust the flow rate of refrigerant that flows through the first bypass pipe 21, by a simple opening/closing operation that is performed by turning on/off the injection refrigerant pressure-reducing device 5*c*. However, the configuration of the injection refrigerant pressure-reducing device 5*c* is not limited to such a configuration. The injection refrigerant pressure-reducing device 5*c* may be an electronic expansion valve whose opening degree can be finely adjusted to adjust the flow rate.

Figure 3:
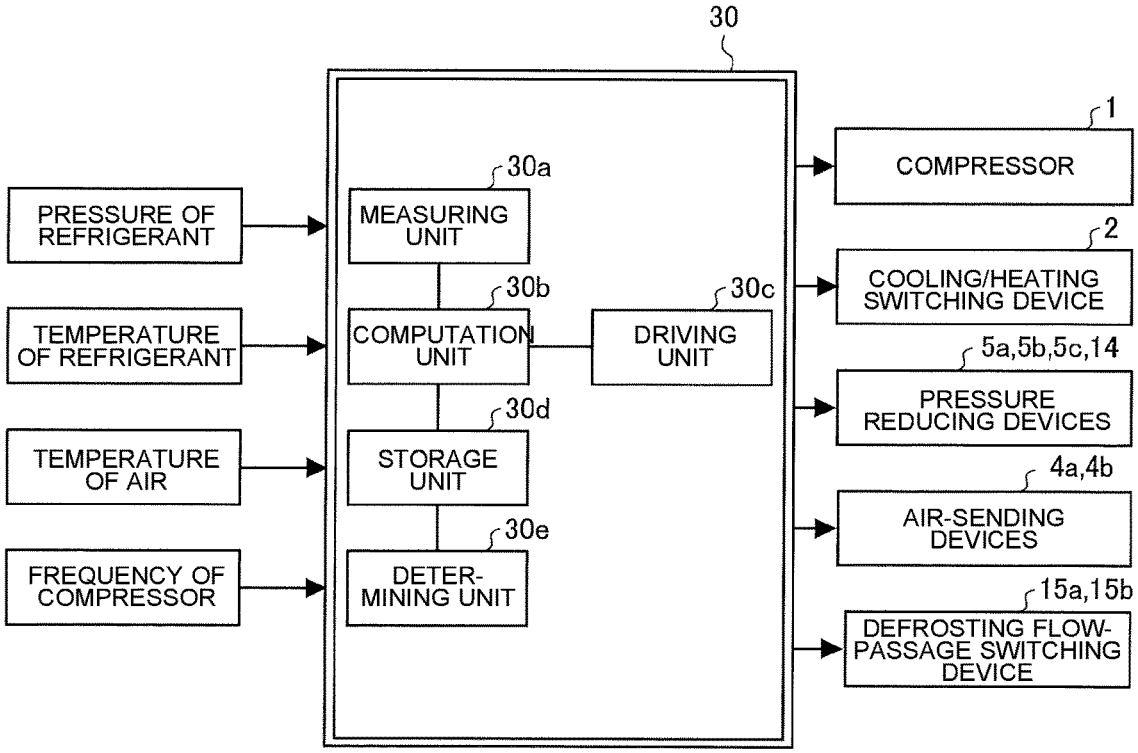
FIG. 3 is a control block diagram illustrating the air-conditioning apparatus according to Embodiment 1 of the present disclosure.

FIG. 3 is a control block diagram illustrating the air-conditioning apparatus 100 according to Embodiment 1 of the present disclosure. FIG. 3 illustrates the controller 30 that performs a measurement control of the air-conditioning apparatus 100, operation information that is connected to the controller 30, and a connection configuration of actuators included in the refrigerant circuit.

The controller 30 is incorporated in the air-conditioning apparatus 100. In this example, a single controller 30 is provided in the heat source unit A. The controller 30 includes a measuring unit 30*a*, a computation unit 30*b*, a driving unit 30*c*, a storage unit 30*d*, and a determining unit 30*e*.

To the measuring unit 30*a*, operation information obtained by detection performed by various sensors is inputted, and the measuring unit 30*a* measures operation-state quantities, such as a pressure, a temperature, or a frequency. The operation-state quantities measured by the measuring unit 30*a* are inputted to the computation unit 30*b*.

Based on the operation-state quantities measured by the measuring unit 30*a*, the computation unit 30*b* computes the physical property values of refrigerant, such as the saturation pressure, saturation temperature, and density of the refrigerant, using a formula or formulas given in advance, for example. The computation unit 30*b* performs a computation processing based on the operation-state quantities measured by the measuring unit 30*a*. This computation processing is performed by a processing circuit, such as a CPU.

Based on the results of the computation performed by the computation unit 30*b*, the driving unit 30*c* drives the compressor 1, the cooling/heating switching device 2, the first outdoor fan 4*a*, the second outdoor fan 4*b*, the pressure reducing device 5*a*, the pressure reducing device 5*b*, the injection refrigerant pressure-reducing device 5*c*, the defrosting refrigerant pressure-reducing device 14, the defrosting flow passage switching device 15*a*, and the defrosting flow passage switching device 15*b*.

The storage unit 30*d* stores, for example, the results obtained by the computation unit 30*b*, predetermined constants, specification values of a device and components of the device, and a function formula or a function table, such as a table, for use in calculation of physical property values, as the saturation pressure, saturation temperature, and density of refrigerant. These content stored in the storage unit 30*d* can be referred to or rewritten as necessary. Also, a control program is stored in the storage unit 30*d*, and the controller 30 controls the air-conditioning apparatus 100 according to the program in the storage unit 30*d*.

Because of provision of the above configuration, the controller 30 individually controls the operations of the compressor 1, the cooling/heating switching device 2, the first outdoor fan 4*a*, the second outdoor fan 4*b*, the pressure reducing device 5*a*, the pressure reducing device 5*b*, the injection refrigerant pressure-reducing device 5*c*, the defrosting refrigerant pressure-reducing device 14, the defrosting flow passage switching device 15*a*, and the defrosting flow passage switching device 15*b*.

The determining unit 30*e* performs processing, such as magnitude comparison or determination, based on the results obtained by the computation unit 30*b*.

Each of the measuring unit 30*a*, the computation unit 30*b*, the driving unit 30*c*, and the determining unit 30*e* is, for example, a microcontroller. The storage unit 30*d* is, for example, a semiconductor memory.

Although it is described above that the controller 30 is incorporated in the air-conditioning apparatus 100, it is done by way of example and it is not limiting. The controller 30 may be configured such that a main control unit is provided in the heat source unit A, a sub control unit having part of the function of the control unit is provided in the use unit B, and the main control unit and the sub control unit communicate with each other as data communication to perform a cooperative processing, or the controller 30 may be configured such that a control unit having all functions is provided in the use unit B, or the controller 30 may be configured such that a control unit is provided outside the heat source unit A and the use unit B.

<Basic Operation of Air-Conditioning Apparatus 100>

It will be described how the air-conditioning apparatus 100 is operated in each of operation modes.

<Cooling Operation>

Figure 4:
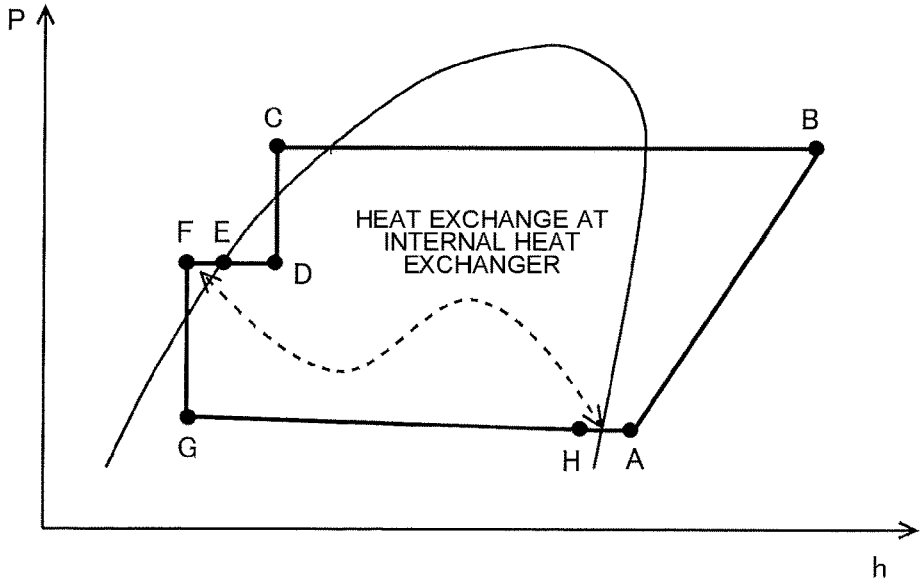
FIG. 4 is a P-h diagram indicating state transition of refrigerant in a cooling operation mode of the air-conditioning apparatus according to Embodiment 1 of the present disclosure.

FIG. 4 is a P-h diagram indicating state transition of refrigerant in a cooling operation mode of the air-conditioning apparatus 100 according to Embodiment 1 of the present disclosure. The cooling operation will be described with reference to FIGS. 1 and 4.

During the cooling operation, the cooling/heating switching device 2 is in the state indicated by the broken lines in FIG. 1, whereby the discharge-side portion of the compressor 1 is connected to the gas-side part of the outdoor heat exchanger 3, and the suction-side portion of the compressor 1 is connected to the gas-side part of the indoor heat exchanger 7. In this state, the defrosting refrigerant pressure-reducing device 14 is in a fully opened state. The defrosting flow passage switching device 15*a* and the defrosting flow passage switching device 15*b* are each in a state indicated by broken lines in FIG. 1, as well as the cooling/heating switching device 2.

High-temperature and high-pressure gas refrigerant discharged from the compressor 1 passes through the cooling/heating switching device 2, passes through the defrosting flow passage switching device 15*a* or the defrosting flow passage switching device 15*b*, and reaches the outdoor heat exchanger 3 that operates as a condenser. In the second connection pipe 42, the flow of refrigerant is stopped by the backflow prevention device 16. In the outdoor heat exchanger 3, refrigerant is condensed and liquefied by air sent by the first outdoor fan 4*a* and the second outdoor fan 4*b* to change into high-pressure and low-temperature refrigerant. The condensed and liquefied high-pressure and low-temperature refrigerant is reduced in pressure by the pressure reducing device 5*a* to change into intermediate-pressure two-phase refrigerant. The intermediate-pressure two-phase refrigerant passes through the receiver 11, is further reduced in pressure by the pressure reducing device 5*b*, and is then sent to the use unit B through the liquid connection pipe 6. The refrigerant sent to the use unit B is sent to the indoor heat exchanger 7. The two-phase refrigerant reduced in pressure is evaporated, at the indoor heat exchanger 7 that operates as an evaporator, by air sent by the indoor fan 8, to change into low-pressure gas refrigerant. The low-pressure gas refrigerant passes through the cooling/heating switching device 2, exchanges heat, at the receiver 11, with intermediate-pressure two-phase refrigerant between the pressure reducing device 5*a* and the pressure reducing device 5*b*, and is then re-sucked by the compressor 1.

Intermediate-pressure and low-temperature two-phase refrigerant that is reduced in pressure by the pressure reducing device 5*a* and sent from the heat source unit A to the use unit B changes into saturated liquid refrigerant in the receiver 11 and is then subcooled by heat exchange with low-pressure and lower-temperature refrigerant that circulates between the cooling/heating switching device 2 and the suction side of the compressor 1. This change is a change from point D to point E, and then to point F as indicated in FIG. 4. At the same time as the above change, low-pressure refrigerant is superheated by heat exchange to change into superheated low-pressure gas refrigerant, and then flows into the compressor 1. This change is a change from point H to point A in FIG. 4. Because of the operation of such heat exchange at the receiver 11, the enthalpy of refrigerant that flows into the indoor heat exchanger 7 decreases, thus increasing the difference between the enthalpy of refrigerant at the inlet and the outlet of the indoor heat exchanger 7. Therefore, the circulation amount of refrigerant that is required for obtaining a predetermined capacity is reduced, and a pressure loss is reduced, whereby the COP of the refrigeration cycle circuit can be improved. Furthermore, low-pressure refrigerant that flows into the compressor 1 is changed into a superheated gas refrigerant, and it is therefore possible to avoid liquid back that would be caused by excessive inflow of liquid refrigerant into the compressor 1.

The opening degree of the pressure reducing device 5*a* is adjusted to cause the degree of subcooling of refrigerant at the outlet of the outdoor heat exchanger 3 to reach a predetermined value, and the flow rate of refrigerant is controlled. Therefore, liquid refrigerant condensed in the outdoor heat exchanger 3 is caused to have a predetermined degree of subcooling. The degree of subcooling of refrigerant at the outlet of the outdoor heat exchanger 3 is detected as a value that is obtained by subtracting a value corresponding to the condensing temperature Tc of refrigerant at the gas-side temperature sensor 202*a* or the gas-side temperature sensor 202*b*, from a value obtained by detection performed by the liquid-side temperature sensor 204*a* or the liquid-side temperature sensor 204*b*. The degree of subcooling of refrigerant may be detected using, as representative temperature sensors, temperature sensors of the first parallel outdoor heat exchanger 3*a* or those of the second parallel outdoor heat exchanger 3*b*, that is, one of the gas-side temperature sensor 202*a* and the gas-side temperature sensor 202*b* and one of the liquid-side temperature sensor 204*a* and the liquid-side temperature sensor 204*b*. Alternatively, the degree of subcooling of refrigerant may be detected using the average value of values obtained by the gas-side temperature sensor 202*a* and the gas-side temperature sensor 202*b* and the average value of values obtained by the liquid-side temperature sensor 204*a* and the liquid-side temperature sensor 204*b*.

The opening degree of the pressure reducing device 5*b* is adjusted to cause the temperature of refrigerant discharged from the compressor 1 to reach a predetermined value, and the flow rate of refrigerant that circulates in the indoor heat exchanger 7 is controlled. Therefore, discharged gas refrigerant discharged from the compressor 1 is caused to have a predetermined temperature. The temperature of refrigerant discharged from the compressor 1 is detected by the discharge temperature sensor 201 of the compressor 1 or a shell temperature sensor 208 of the compressor 1. Because of the above control of the pressure reducing device 5*b*, refrigerant flows in the indoor heat exchanger 7 at a flow rate corresponding to an operation load required for an air-conditioned space where the use unit B is installed.

During the cooling operation, the injection refrigerant pressure-reducing device 5*c* is made to be in a fully closed state, and injection to the compressor 1 is not performed.

<Heating Operation>

Figure 5:
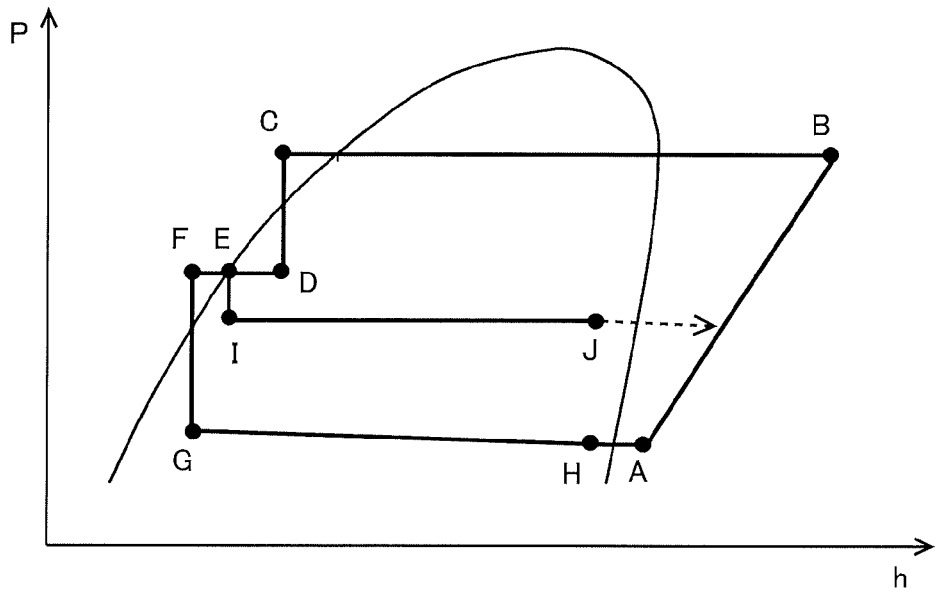
FIG. 5 is a P-h diagram indicating state transition of refrigerant in a heating operation mode of the air-conditioning apparatus according to Embodiment 1 of the present disclosure.

FIG. 5 is a P-h diagram indicating state transition of refrigerant in the heating operation mode of the air-conditioning apparatus 100 according to Embodiment 1 of the present disclosure. The heating operation will be described with reference to FIGS. 1 and 5.

During the heating operation, the cooling/heating switching device 2 is in a state indicated by the solid lines in FIG. 1, that is, in a state where the discharge side of the compressor 1 is connected to the gas side of the indoor heat exchanger 7, and the suction side of the compressor 1 is connected to the gas side of the outdoor heat exchanger 3. In this state, the defrosting refrigerant pressure-reducing device 14 is in a fully opened state. The defrosting flow passage switching device 15*a* and the defrosting flow passage switching device 15*b* are in a state indicated by the solid lines in FIG. 1, as well as the cooling/heating switching device 2.

High-temperature and high-pressure gas refrigerant discharged from the compressor 1 is sent to the use unit B via the cooling/heating switching device 2 and the gas connection pipe 9, and reaches the indoor heat exchanger 7 that operates as a condenser. At the indoor heat exchanger 7, refrigerant is condensed and liquefied by air sent by the indoor fan 8 to change into high-pressure and low-temperature refrigerant. The condensed and liquefied high-pressure and low-temperature refrigerant is sent to the heat source unit A through the liquid connection pipe 6. The refrigerant sent to the heat source unit A is reduced in pressure by the pressure reducing device 5*b* to change into intermediate-pressure two-phase refrigerant. The intermediate-pressure two-phase refrigerant passes through the receiver 11, and is further reduced in pressure by the pressure reducing device 5*a* and then sent to the outdoor heat exchanger 3. At the outdoor heat exchanger 3 that operates as an evaporator, the two-phase refrigerant reduced in pressure is evaporated by air sent by the first outdoor fan 4*a* and the second outdoor fan 4*b* to change into low-pressure gas refrigerant. The low-pressure gas refrigerant passes through the defrosting flow passage switching device 15*a*, the defrosting flow passage switching device 15*b*, and the first connection pipe 41, exchanges heat, at the receiver 11, with intermediate-pressure two-phase refrigerant between the pressure reducing device 5*a* and the pressure reducing device 5*b*, and is then re-sucked into the compressor 1.

The low-temperature and intermediate-pressure two-phase refrigerant sent from the use unit B to the heat source unit A and reduced in pressure by the pressure reducing device 5*b* changes into saturated liquid refrigerant in the receiver 11, and is then subcooled by heat exchange with lower-temperature and low-pressure refrigerant that circulates between the cooling/heating switching device 2 and the suction side of the compressor 1. This change is a change from point D to point E and then to point F as indicated in FIG. 5. At the same time as the above change, the low-pressure refrigerant is superheated by heat exchange to change into superheated low-pressure gas refrigerant, and flows into the compressor 1. This change is a change from point H to point A as indicated in FIG. 5. Because of the above heat exchange action at the receiver 11, the enthalpy of refrigerant the flows into the outdoor heat exchanger 3 decreases, thus increasing the difference between the enthalpy of refrigerant at the inlet of the outdoor heat exchanger 3 and that at the outlet of the outdoor heat exchanger 3. Therefore, the circulation amount of refrigerant required for obtaining a predetermined capacity is reduced, and a pressure loss is reduced, as a result of which the COP of the refrigeration cycle can be improved. In addition, low-pressure refrigerant that flows into the compressor 1 is changed into superheated gas refrigerant, and it is therefore possible to avoid liquid back that would be caused by excessive inflow of liquid refrigerant into the compressor 1.

In order to prevent the temperature of refrigerant discharged from the compressor 1 from excessively rising, the injection refrigerant pressure-reducing device 5*c* controls the flow rate of refrigerant that is injected into the compressor 1 via the first bypass pipe 21. Part of refrigerant the pressure of which is reduced at the pressure reducing device 5*b* branches off from the refrigerant to flow into the first bypass pipe 21, and is reduced in pressure at the injection refrigerant pressure-reducing device 5*c* to change into two-phase refrigerant. This change is a change from point E to point I as indicated in FIG. 5. The two-phase refrigerant the pressure of which is reduced by the injection refrigerant pressure-reducing device 5*c* exchanges heat, at the internal heat exchanger 13, with refrigerant the pressure of which is reduced at the pressure reducing device 5*b*, thus changing into two-phase refrigerant having a high ratio of gas to liquid, that is, having high quality. This change is a change from point I to point J as indicated in FIG. 5. This two-phase refrigerant having high quality is injected into the compressor 1 through the first bypass pipe 21. As a result, it is possible to reduce the degree of a temperature rise of the refrigerant discharged from the compressor 1. Thus even when the outside air temperature is low, the compressor 1 can be operated with a high operating frequency. Therefore, compared with the case where injection is not performed, it is possible to improve the heating capacity even under a condition in which the outside air temperature is low.

The opening degree of the pressure reducing device 5*b* is adjusted to cause the degree of subcooling of refrigerant at the outlet of the indoor heat exchanger 7 to reach a predetermined value, and the flow rate of refrigerant that flows in the indoor heat exchanger 7 is controlled. Therefore, liquid refrigerant condensed at the indoor heat exchanger 7 is made to have a predetermined degree of subcooling. The degree of subcooling of refrigerant at the outlet of the indoor heat exchanger 7 is detected as a value that is obtained by subtracting a value corresponding to the condensing temperature Tc of refrigerant at the gas-side temperature sensor 207, from a value obtained by detection performed by the liquid-side temperature sensor 205.

The opening degree of the pressure reducing device 5*a* is adjusted to cause the degree of superheat of the refrigerant discharged from the compressor 1 to reach a predetermined value, and the flow rate of refrigerant that circulates in the outdoor heat exchanger 3 is controlled. Therefore, gas refrigerant discharged from the compressor 1 is made to have a predetermined temperature. The degree of superheat of refrigerant discharged from the compressor 1 is calculated by subtracting a value corresponding to the condensing temperature Tc of refrigerant at the gas-side temperature sensor 207, from a value obtained by detection performed by the discharge temperature sensor 201 of the compressor 1 or the shell temperature sensor 208 of the compressor 1. Because of the above control of the pressure reducing device 5*a*, refrigerant flows in the indoor heat exchanger 7 at a flow rate corresponding to an operation load required for an air-conditioned space where the use unit B is installed.

In Embodiment 1, the value obtained by detection performed by the temperature sensor provided at each of the heat exchangers is used as the condensing temperature of refrigerant. However, the following may be adopted: a pressure sensor is provided on the discharge side of the compressor 1 to detect the discharge pressure of refrigerant, the detected discharge pressure is converted into a saturation temperature, and the saturation temperature is used as the condensing temperature of refrigerant.

It is described above that the opening degree of the pressure reducing device 5*a* is adjusted to cause the degree of superheat of refrigerant discharged from the compressor 1 to each a predetermined value. However, the opening degree of the pressure reducing device 5*a* may be adjusted to cause the temperature of refrigerant discharged from the compressor 1 to reach the predetermined value, and the flow rate of refrigerant that circulates in the outdoor heat exchanger 3 is controlled. The temperature of refrigerant discharged from the compressor 1 is detected by the discharge temperature sensor 201 of the compressor 1 or the shell temperature sensor 208 of the compressor 1.

Furthermore, although it is described above on the premise that injection to the compressor 1 is performed, it is not limiting. The injection refrigerant pressure-reducing device 5*c* may be in the fully closed state at all times, and injection to the compressor 1 may not be performed.

<Simultaneous Heating and Defrosting Operation Mode>

Figure 6:
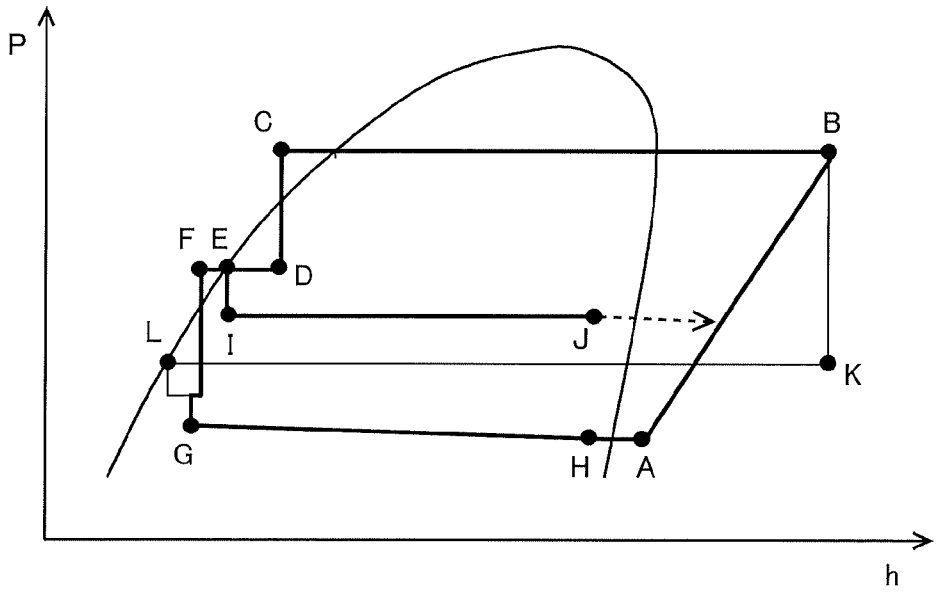
FIG. 6 is a P-h diagram indicating state transition of refrigerant in a simultaneous heating and defrosting operation mode of the air-conditioning apparatus according to Embodiment 1 of the present disclosure.

FIG. 6 is a P-h diagram indicating state transition of refrigerant in the simultaneous heating and defrosting operation mode in the air-conditioning apparatus 100 according to Embodiment 1 of the present disclosure. The simultaneous heating and defrosting operation will be described with reference to FIGS. 1 and 6. A description of part of the simultaneous heating and defrosting operation that is same as or equivalent to part of the heating operation will be omitted.

In the simultaneous heating and defrosting operation mode, the heating operation and the defrosting operation are simultaneously performed such that while the heating operation is continued on the indoor side, defrosting refrigerant is made to flow into the bypass circuit on the outdoor side to alternately defrost the first parallel outdoor heat exchanger 3*a* and the second parallel outdoor heat exchanger 3*b*.

During the simultaneous heating and defrosting operation, the cooling/heating switching device 2 is in the state indicated by the solid lines in FIG. 1 as in the heating operation. The defrosting flow passage switching device 15*a* and the defrosting flow passage switching device 15*b* are controlled to cause part of refrigerant discharged from the compressor 1 to branch off from the discharged refrigerant and flow into one of the first parallel outdoor heat exchanger 3*a* and the second parallel outdoor heat exchanger 3*b* that is a defrosting target, that is, a heat exchanger to be defrosted. Therefore, one of the defrosting flow passage switching device 15*a* and the defrosting flow passage switching device 15*b* that is provided at the one of the first parallel outdoor heat exchanger 3*a* and the second parallel outdoor heat exchanger 3*b* that is the defrosting target is in the state indicated by the broken lines in FIG. 1. The other of the defrosting flow passage switching device 15*a* and the defrosting flow passage switching device 15*b* that is provided on the other of the first parallel outdoor heat exchanger 3*a* and the second parallel outdoor heat exchanger 3*b* that is not the defrosting target is in the state indicated by the solid lines in FIG. 1.

When defrosting of the one of the first parallel outdoor heat exchanger 3*a* and the second parallel outdoor heat exchanger 3*b* that is the defrosting target is completed, the states of the defrosting flow passage switching device 15*a* and the defrosting flow passage switching device 15*b* are reversed by switching operation. Because of this switching operation, the relationship between one of the heat exchangers that is the defrosting target and the other heat exchanger that is not the defrosting target is reversed. In such a manner, the first parallel outdoor heat exchanger 3*a* and the second parallel outdoor heat exchanger 3*b* are alternately defrosted.

The above switching operation to reverse the state of the defrosting flow passage switching device 15*a* and that of the defrosting flow passage switching device 15*b* may be repeatedly performed to alternately defrost the first parallel outdoor heat exchanger 3*a* and the second parallel outdoor heat exchanger 3*b* repeatedly.

In the following description, it is assumed that the first parallel outdoor heat exchanger 3*a* is the defrosting target, and the second parallel outdoor heat exchanger 3*b* is not the defrosting target.

High-temperature and high-pressure gas refrigerant discharged from the compressor 1 is sent to the use unit B via the cooling/heating switching device 2 and the gas connection pipe 9, and reaches the indoor heat exchanger 7 that operates as a condenser. At the indoor heat exchanger 7, the refrigerant is condensed and liquefied by air sent from the indoor fan 8 to change into high-pressure and low-temperature refrigerant. The condensed and liquefied high-pressure and low-temperature refrigerant is sent to the heat source unit A through the liquid connection pipe 6. The refrigerant sent to the heat source unit A is reduced in pressure by the pressure reducing device 5*b* to change into intermediate-pressure two-phase refrigerant. The intermediate-pressure two-phase refrigerant passes through the receiver 11, and is further reduced in pressure by the pressure reducing device 5*a* and then sent to the second parallel outdoor heat exchanger 3*b*.

In contrast, part of the high-temperature and high-pressure gas refrigerant discharged from the compressor 1 branches off from the above discharged refrigerant to flows to the second bypass pipe 22, and is reduced in pressure by the defrosting refrigerant pressure-reducing device 14 to change into intermediate-pressure gas refrigerant. The intermediate-pressure gas refrigerant reaches the first parallel outdoor heat exchanger 3*a* via the defrosting flow passage switching device 15*a*. This change is a change from point B to point K as indicated in FIG. 6. The intermediate-pressure gas refrigerant that flows into the first parallel outdoor heat exchanger 3*a* exchanges heat with frost adhering to the first parallel outdoor heat exchanger 3*a* because of defrosting, and is condensed and liquefied by the condensing action to change into intermediate-pressure liquid refrigerant. This change is a change from point K to point L in FIG. 6. Because of this action, the frost adhering to the first parallel outdoor heat exchanger 3*a* is defrosted. The intermediate-pressure liquid refrigerant that flows out of the first parallel outdoor heat exchanger 3*a* joins intermediate-pressure two-phase refrigerant that is reduced in pressure by the pressure reducing device 5*a*, and is sent to the second parallel outdoor heat exchanger 3*b*. This change is a change from point L to point G as indicated in FIG. 6. The joined two-phase refrigerant is evaporated, at the second parallel outdoor heat exchanger 3*b* that operates as an evaporator, by air sent from the second outdoor fan 4*b*, to change into low-pressure gas refrigerant. The low-pressure gas refrigerant passes through the defrosting flow passage switching device 15*b* and the first connection pipe 41, exchanges heat, at the receiver 11, with intermediate-pressure two-phase refrigerant between the pressure reducing device 5*a* and the pressure reducing device 5*b*, and is then re-sucked into the compressor 1.

<Control of Air-Conditioning Apparatus in Simultaneous Heating and Defrosting Operation Mode>

Figure 7:
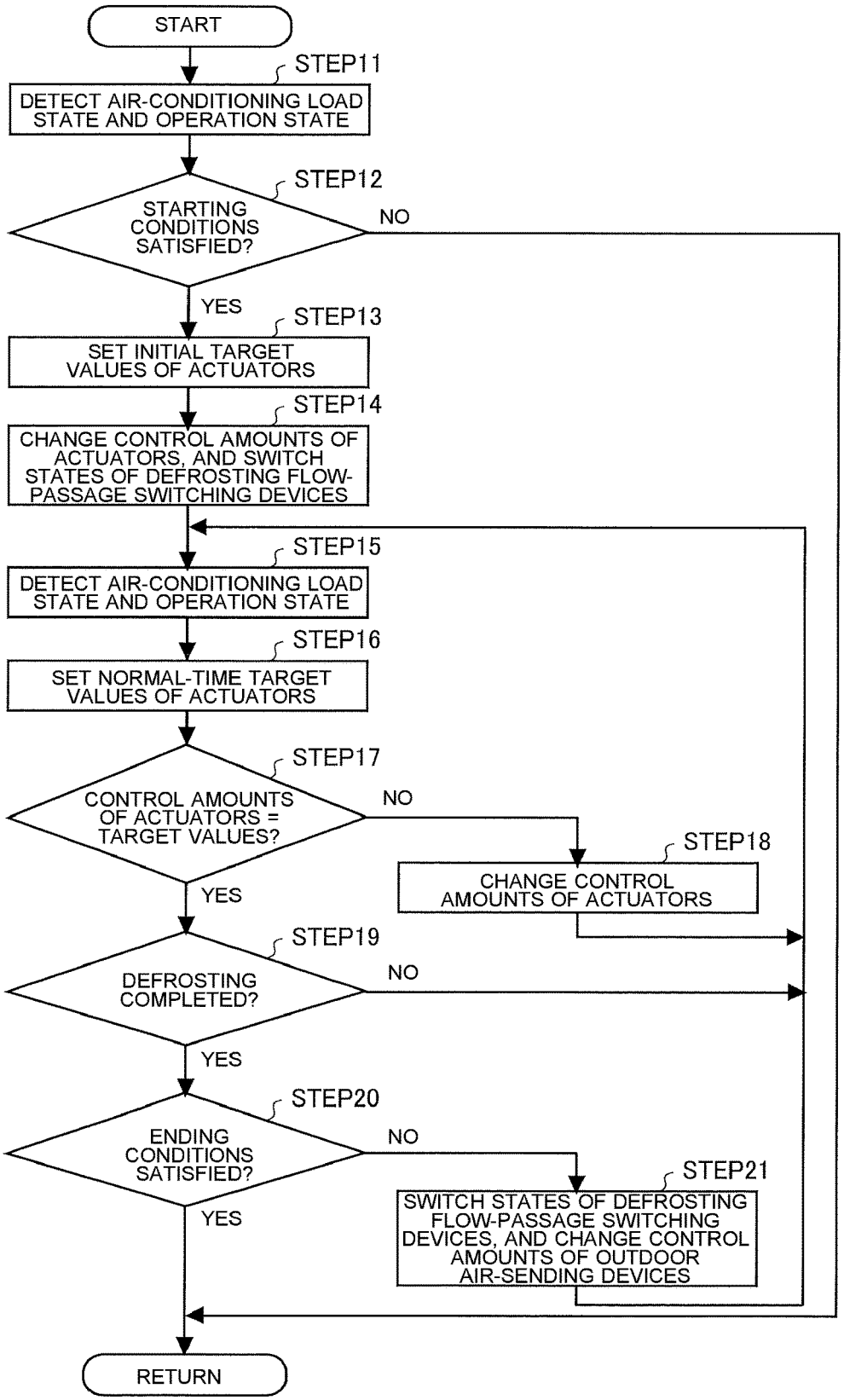
FIG. 7 is a flowchart indicating the flow of a control operation in the simultaneous heating and defrosting operation mode in the air-conditioning apparatus according to Embodiment 1 of the present disclosure.

FIG. 7 is a flowchart indicating the flow of the control operation in the simultaneous heating and defrosting operation mode in the air-conditioning apparatus 100 according to Embodiment 1 of the present disclosure. The control operation of the air-conditioning apparatus 100 in the simultaneous heating and defrosting operation mode will be described with reference to FIG. 7.

When a routine in this mode is started, the measuring unit 30*a* of the controller 30 detects an air-conditioning load state and an operation state of the air-conditioning apparatus 100 that is in the heating operation (STEP 11).

An air-conditioning load state detection unit uses: for example, a sensor that is provided in the use unit B of the air-conditioning apparatus 100 to measure an indoor air temperature; a set indoor temperature set by a user with a controller (not illustrated) that controls the air-conditioning apparatus 100; and a temperature sensor that is provided in the heat source unit A to measure an outside air temperature. An air-conditioning load state is detected based on such detection information as described above. The indoor temperature sensor 206 is used as the sensor that measures the indoor air temperature, and the outside air temperature sensor 203*a* and the outside air temperature sensor 203*b* are used as the sensors that measure the outside air temperature.

As operation-state detection units, for example, a temperature sensor that is provided at the heat source unit A or the use unit B of the air-conditioning apparatus 100 to measure a refrigerant temperature or an air temperature and a sensor (not illustrated) that detects the operating frequency of the compressor 1 are used. An operation state is detected based on such detection information as described above.

Next, the determining unit 30*e* of the controller 30 determines whether starting conditions for starting the simultaneous heating and defrosting operation mode are satisfied or not based on the air-conditioning load state and the operation state detected by the measuring unit 30*a* (STEP 12). When it is determined that the above conditions are satisfied, the processing proceeds to STEP 13 (YES in STEP 12). When it is determined that the starting conditions are not satisfied, the routine is ended once, and a normal heating operation is continued (NO in STEP 12).

In the determination whether the staring conditions for starting the simultaneous heating and defrosting operation mode are satisfied or not, for example, a deviation of an indoor temperature from a set indoor temperature or the outside air temperature is used as a determination index for an air-conditioning load state, and the operating frequency of the compressor 1 or a liquid pipe temperature of the outdoor heat exchanger 3 is used as a determination index for an operation state. A detection value obtained by detection performed by the liquid-side temperature sensor 204*a* or the liquid-side temperature sensor 204*b* is used as the liquid-pipe temperature of the outdoor heat exchanger 3.

The following is a concrete determination method of determining the above starting conditions are satisfied or not. It is determined that the starting conditions are satisfied when the following conditions are satisfied: for example, (1) the condition in which the deviation of the indoor temperature from the set indoor temperature and the indoor temperature is less than or equal to a predetermined value; (2) the condition in which the operating frequency of the compressor 1 is less than or equal to a predetermined value; (3) the condition in which the liquid pipe temperature of the outdoor heat exchanger 3 is less than or equal to a predetermined value; and (4) the condition in which the outside air temperature is greater than or equal to a predetermined value. It should be noted that the above conditions (1) to (4) are examples of the starting conditions, and a further condition or conditions may be added, and the above conditions may be changed to other conditions.

Subsequently, based on the air-conditioning load state and the operation state detected by the measuring unit 30*a*, the controller 30 sets initial control target values of actuators of the refrigerant circuit of the air-conditioning apparatus 100 (STEP 13). The initial control target values are target values that are set for the compressor 1, the pressure reducing device 5*a*, the pressure reducing device 5*b*, the defrosting refrigerant pressure-reducing device 14, and other devices in the simultaneous heating and defrosting operation mode based on an air-conditioning load state and an operation state that are detected immediately before the operation mode is switched from the heating operation mode to the simultaneous heating and defrosting operation mode.

The initial control target value is also a target value that is set for the injection refrigerant pressure-reducing device 5*c*. In the injection refrigerant pressure-reducing device 5*c*, the initial control target value is set as a target value in the simultaneous heating and defrosting operation mode at the point of time immediately after the operation mode is switched from the heating operation mode to the simultaneous heating and defrosting operation mode. For the injection refrigerant pressure-reducing device 5*c*, an initial control target value for causing the injection refrigerant pressure-reducing device 5*c* to be continuously opened in the simultaneous heating and defrosting operation mode is set.

The above actuators are the compressor 1, the pressure reducing device 5*a*, the pressure reducing device 5*b*, the injection refrigerant pressure-reducing device 5*c*, the defrosting refrigerant pressure-reducing device 14, the first outdoor fan 4*a*, and the second outdoor fan 4*b*.

As a concrete method of setting the initial control target value, for example, an initial control target value for the compressor 1 is set to the maximum controllable frequency in the air-conditioning apparatus 100.

In the case where the first parallel outdoor heat exchanger 3*a* is set as a first defrosting target, the initial control target value of the first outdoor fan 4*a* is set to cause the first outdoor fan 4*a* to be stopped, or the rotation speed of the first outdoor fan 4*a* to be reduced to the minimum controllable rotation speed, and the initial control target value of the second outdoor fan 4*b* that is not an outdoor fan on the defrosting target side is set to cause the rotation speed of the second outdoor fan 4*b* to be maintained or to be increased to the maximum controllable rotation speed.

The initial control target values of the defrosting refrigerant pressure-reducing device 14, the pressure reducing device 5*a*, and the pressure reducing device 5*b* are set in consideration of an increase in the frequency of the compressor 1 at the time of switching the mode from the heating operation mode to the simultaneous heating and defrosting operation mode, and a change in the flow rate of refrigerant that is made by a decrease in a heat transfer performance AK value that is caused by the division of the outdoor heat exchanger 3 that operates as an evaporator. For example, the flow rate Gr of refrigerant can be calculated using the following equation.

[Math. 1]

$$G_r = V_{ST} \times F \times \rho_S \times \eta_V \quad (1)$$

In the equation, Vst is the stroke volume [$m^3$] of the compressor 1, F is the operating frequency [Hz] of the compressor 1, ρs is the density [$kg/m^3$] of sucked refrigerant at the compressor 1, and ηv is a volume efficiency [-]. The stroke volume Vst of the compressor and the volume efficiency ηv are the specification value or the intrinsic characteristic value of the compressor 1, and the density ρs of the sucked refrigerant at the compressor can be calculated based on an operation state of the refrigerant circuit using physical property values of refrigerant.

Based on the above information, such as the formula for calculating the flow rate of refrigerant, the physical property values of refrigerant, and the device specification of the air-conditioning apparatus 100, initial control target values are calculated in advance as values corresponding to a change of an operation state at the time of switching the operation mode from the heating operation mode to the simultaneous heating and defrosting operation mode. For example, an arithmetic expression is stored in advance in the storage unit 30*d* such that the operating frequency of the compressor 1 and the refrigerant temperatures in the indoor and outdoor heat exchangers, which are operation states, are applied as parameters. The computation unit 30*b* calculates the initial control target values from the information, such as the above arithmetic expression, based on the air-conditioning load state and the operation state detected by the measuring unit 30*a*, and sets the initial control target values.

In the case where the injection refrigerant pressure-reducing device 5*c* is in the fully closed state immediately before the switching of the operation mode, the initial control target value of the injection refrigerant pressure-reducing device 5*c* is set to cause the injection refrigerant pressure-reducing device 5*c* to be fully opened, and cause the opening degree of the injection refrigerant pressure-reducing device 5*c* to reach a predetermined opening degree. In contrast, in the case where the injection refrigerant pressure-reducing device 5*c* is not in the fully closed state immediately before the switching of the operation mode, the initial control target value of the injection refrigerant pressure-reducing device 5*c* is set to cause the opening degree of the injection refrigerant pressure-reducing device 5*c* during the heating operation to be maintained.

The initial control target value of the compressor 1 may be set as follows. The operation time of the air-conditioning apparatus 100 from the start of the heating operation and the operation time of the compressor 1 from the start-up thereof are measured, and a required defrosting capacity is estimated based on the above operation times, and the outside air temperature and specification information of an outdoor heat exchanger 3 set as a defrosting target. Then, the operating frequency of the compressor 1 is increased by an amount corresponding to the above required defrosting capacity.

The initial control target values of the first outdoor fan 4*a* and the second outdoor fan 4*b* may be changed based on an outside air temperature detected as an air-conditioning load state. For example, the initial control target value of the first outdoor fan 4*a* on the defrosting target side may be set such that in the case where the outside air temperature is less than or equal to a predetermined value, the first outdoor fan 4*a* is stopped or the rotation speed of the first outdoor fan 4*a* is reduced to the minimum controllable rotation speed, and in the case where the outside air temperature is greater than or equal to the predetermined value, the rotation speed of the first outdoor fan 4*a* is maintained or is increased to the maximum controllable rotation speed. In contrast, in the simultaneous heating and defrosting operation mode, the control amount of the second outdoor fan 4*b* for the second parallel outdoor heat exchanger 3*b* that is not the defrosting target may be set such that the current value is maintained or increased to the maximum value.

As described above, in the simultaneous heating and defrosting operation mode, the operations of the first outdoor fan 4*a* and the second outdoor fan 4*b* are individually controlled.

Subsequently, regarding the defrosting flow passage switching device 15*a* and the defrosting flow passage switching device 15*b*, the driving unit 30*c* of the controller 30 causes the defrosting flow passage switching device 15*a* provided for the first parallel outdoor heat exchanger 3*a* that is the defrosting target to be in the state indicated by the broken lines in FIG. 1, and causes the defrosting flow passage switching device 15*b* provided for the second parallel outdoor heat exchanger 3*b* that is not the defrosting target to be the state indicated by the solid lines in FIG. 1. Then, the controller 30 changes the control amounts of actuators, that is, the compressor 1, the pressure reducing device 5*a*, the pressure reducing device 5*b*, the injection refrigerant pressure-reducing device 5*c*, the defrosting refrigerant pressure-reducing device 14, the first outdoor fan 4*a*, and the second outdoor fan 4*b*, to the initial control target values (STEP 14).

As described above, at the time of starting the simultaneous heating and defrosting operation mode, the control amounts of the compressor 1, the pressure reducing device 5*a*, the pressure reducing device 5*b*, the defrosting refrigerant pressure-reducing device 14, and other actuators are controlled to be set to the respective initial control target values.

Then, after the control amounts of the compressor 1, the pressure reducing device 5*a*, the pressure reducing device 5*b*, the defrosting refrigerant pressure-reducing device 14, and other actuators reach the respective initial control target values, as will be described later, the control amounts of the pressure reducing device 5*a*, the pressure reducing device 5*b*, the defrosting refrigerant pressure-reducing device 14, and other actuators are controlled to be set to respective normal-time control target values.

After the control amounts of the respective actuators reach the initial control target values, and the operations are completed, the measuring unit 30*a* of the controller 30 detects the air-conditioning load state and the operation state of the air-conditioning apparatus 100 (STEP 15).

Next, the controller 30 sets normal-time control target values of the actuators in the simultaneous heating and defrosting operation mode based on the air-conditioning load state and the operation state of the air-conditioning apparatus 100 that are detected by the measuring unit 30*a* (STEP 16).

As a method of setting a normal-time control target value, for example, the normal-time control target value of the pressure reducing device 5*b* is set such that the opening degree of the pressure reducing device 5*b* is adjusted to cause the degree of subcooling of refrigerant at the outlet of the indoor heat exchanger 7 to reach a predetermined value as in the heating operation.

A normal-time control target value of the pressure reducing device 5*a* is set such that the opening degree of the pressure reducing device 5*a* is adjusted to cause the degree of superheat of refrigerant discharged from the compressor 1 to reach a predetermined value. The degree of superheat of refrigerant discharged from the compressor 1 is calculated as a value that is obtained by subtracting a value corresponding to the condensing temperature Tc of refrigerant at the gas-side temperature sensor 207, from a detection value obtained by detection performed by the discharge temperature sensor 201 of the compressor 1. The normal-time control target value of the injection refrigerant pressure-reducing device 5*c* is set to a target value that is required to cause the control amount changed in STEP 14 to be maintained.

That is, in the case where the opening degree of the injection refrigerant pressure-reducing device 5*c* reaches the initial control target value, the normal-time control target value of the pressure reducing device 5*a* is set to an opening degree that is required to cause the degree of superheat of refrigerant discharged from the compressor 1 to reach a predetermined value, and the normal-time control target value of the injection refrigerant pressure-reducing device 5*c* is kept at the initial control target value of the injection refrigerant pressure-reducing device 5*c*.

An opening degree correction amount of the defrosting refrigerant pressure-reducing device 14 is calculated based on the deviation of the indoor temperature from the set indoor temperature, and the normal-time control target value of the defrosting refrigerant pressure-reducing device 14 is set. The control target value of the defrosting refrigerant pressure-reducing device 14 is calculated by, for example, the following equation.

[Math. 2]

$$S_j = S_{j0} - \Delta_{tj} \quad (2)$$

In the equation, Sj is the opening degree target value of the defrosting refrigerant pressure-reducing device 14, Sj0 is the current opening degree of the defrosting refrigerant pressure-reducing device 14, and Δtj is the opening degree correction amount based on the deviation of the indoor temperature from the set temperature. A set value set by a user with a controller (not illustrated) that operates the air-conditioning apparatus 100 is used as the set indoor temperature, and the detection value obtained by detection performed by the indoor temperature sensor 206 is used as the indoor temperature.

In the case where the defrosting refrigerant pressure-reducing device 14 is not in the fully opened state, the current normal-time control target value of the compressor 1 is set. In the case where the defrosting refrigerant pressure-reducing device 14 is in the fully opened state, the normal-time control target value of the compressor 1 is set such that the operating frequency is adjusted based on the deviation of the indoor temperature from the set temperature.

In the simultaneous heating and defrosting operation mode, the normal-time control target values may be set such that the control amount of at least one of the opening degree of the defrosting refrigerant pressure-reducing device 14 and the operating frequency of the compressor 1 is adjusted based on the deviation of the indoor temperature, which is the indoor load state, from the set temperature.

It should be noted that it is described above that the control amount of the injection refrigerant pressure-reducing device 5*c* that is set as the initial control target value is maintained. However, the normal-time control target value of the injection refrigerant pressure-reducing device 5*c* may be set such that the opening degree of the injection refrigerant pressure-reducing device 5*c* is adjusted to cause the degree of superheat of refrigerant discharged from the compressor 1 to reach a predetermined value. In this case, the normal-time control target value of the pressure reducing device 5*a* is set such that the pressure reducing device 5*a* is adjusted in opening degree to cause the degree of superheat of refrigerant suctioned into the compressor 1 reaches a predetermined value.

The degree of superheat of refrigerant sucked into the compressor 1 is calculated as a value that is obtained by subtracting a value corresponding to the evaporating temperature Te of refrigerant at the gas-side temperature sensor 202*a* or the gas-side temperature sensor 202*b*, from the temperature Ts of sucked refrigerant at the compressor 1. It should be noted that a temperature sensor may be provided on the suction side of the compressor 1, and the temperature Ts of the sucked refrigerant at the compressor 1 may be directly detected by the temperature sensor on the suction side of the compressor 1. Alternately, the temperature Ts of the sucked refrigerant may be estimated from detection values obtained by detection performed by other sensors, as will be described subsequently.

Supposing the compression process of the compressor 1 is a polytropic change of s polytropic index n, the temperature Ts of the sucked temperature can be calculated by the following formula using: a value corresponding to the suction pressure of the compressor 1, which is a low pressure Ps obtained by converting the evaporating temperature Te of refrigerant into a saturation pressure; a value corresponding to the discharge pressure of the compressor 1, which is a high pressure Pd obtained by converting the condensing temperature Tc of refrigerant into a saturation pressure; and a discharge temperature Td of refrigerant.

[Math. 3]

$$T_s = T_d \times \left(\frac{P_s}{P_d}\right)^{\frac{n-1}{n}} \quad (3)$$

In the equation, each of Ts and Td is a temperature [K], each of Ps and "Pd" is a pressure [MPa], and n is a polytropic index [−]. The polytropic index may be a constant. For example, the polytropic index n may be set to 1.2 (n=1.2). However, when the polytropic index is defined as the function of Ps and Pd, the temperature Ts of the sucked refrigerant at the compressor 1 can be estimated with higher accuracy.

The normal-time control target values of the first outdoor fan 4*a* and the second outdoor fan 4*b* may be kept at the initial control target values of the first outdoor fan 4*a* and the second outdoor fan 4*b*. Alternatively, the normal-time control target values of the first outdoor fan 4*a* and the second outdoor fan 4*b* may be changed from the initial control target values based on the outside air temperature detected as an air-conditioning load state. For example, in the case where the outside air temperature becomes less than or equal to a predetermined value in the simultaneous heating and defrosting operation mode, the control amount of the first outdoor fan 4*a* that is the defrosting target is set to cause the first outdoor fan 4*a* to be stopped or the rotational speed of the first outdoor fan 4*a* to be reduced to the minimum controllable rotational speed. In contrast, in the case where the outside air temperature is greater than the predetermined value in the simultaneous heating and defrosting operation mode, the control amount of the first outdoor fan 4*a* that is the defrosting target may be set to cause the rotational speed of the first outdoor fan 4*a* to be increased to a rotational speed in the heating operation at which the first outdoor fan 4*a* rotates before the operation mode is switched from the heating operation mode to the simultaneous heating and defrosting operation mode, or is increased to the maximum controllable rotational speed. The control amount of the second outdoor fan 4*b* that is not defrosting target is kept at the initial control target value.

Next, after the setting of the normal-time control target values of the respective actuator is completed, the controller 30 controls the compressor 1, the pressure reducing devices 5*a* and 5*b*, the defrosting refrigerant pressure-reducing device 14, and other actuators to cause control amounts of these actuators to reach the respective normal-time control target values set based on the air-conditioning load state and the operation state. At this time, in the simultaneous heating and defrosting operation mode, the operations of the first outdoor fan 4*a* and the second outdoor fan 4*b* are individually controlled. The determining unit 30*e* of the controller 30 determines whether or not the control amounts of the actuators reach the normal-time control target values (STEP 17). When it is determined that the control amounts reach the target values, the processing proceeds to a defrosting completion determination (YES in STEP 17). When it is determined that the control amounts do not reach the target values (NO in STEP 17), the driving unit 30*c* changes the control amounts of the actuators (STEP 18). After the processing in STEP 18, the processing returns to STEP 15.

After the control of the respective actuators is completed, the determining unit 30*e* of the controller 30 determines whether or not the defrosting of the first parallel outdoor heat exchanger 3*a* that is the defrosting target is completed (STEP 19). When it is determined that the defrosting is completed, the processing proceeds to the determination of the end of the simultaneous heating and defrosting operation mode (STEP 19; YES). When it is determined that the defrosting is not completed, the processing returns to STEP 15 (STEP 19; NO).

In the defrosting completion determination, the liquid pipe refrigerant temperature in the first parallel outdoor heat exchanger 3*a* that is the defrosting target is used as a determination index. As the liquid pipe refrigerant temperature, a detection value obtained by detection performed by the liquid-side temperature sensor 204*a* is used. For example, when the detection value by the liquid-side temperature sensor 204*a* that is detected by the measuring unit 30*a* becomes greater than or equal to a predetermined value, it is determined that the defrosting is completed.

After the defrosting completion determination regarding the first parallel outdoor heat exchanger 3*a* that is the defrosting target is completed, the determining unit 30*e* of the controller 30 determines whether or not ending conditions for ending the simultaneous heating and defrosting operation mode are satisfied (STEP 20).

When it is determined that the ending conditions for ending are not satisfied (NO in STEP 20), a switching operation is performed such that the states of the defrosting flow passage switching device 15*a* and the defrosting flow passage switching device 15*b* are changed reverse to the states of the defrosting flow passage switching device 15*a* and the defrosting flow passage switching device 15*b* in STEP 14. At the same time, the control amounts of the first outdoor fan 4*a* and the second outdoor fan 4*b* are also changed reverse to the control amounts of the first outdoor fan 4*a* and the second outdoor fan 4*b* in STEP 14 (STEP 21). After the processing in STEP 21, the processing returns to STEP 15.

At the time of performing this repeating operation, the relationship between a defrosting target and a non-defrosting target is reversed between the first parallel outdoor heat exchanger 3*a* and the second parallel outdoor heat exchanger 3*b*. Therefore, the relationships between the sensors provided in association with the first parallel outdoor heat exchanger 3*a* and the second parallel outdoor heat exchanger 3*b* are also reversed. To be more specific, the relationship between the gas-side temperature sensor 202*a* and the gas-side temperature sensor 202*b*, that between the outside air temperature sensor 203*a* and the outside air temperature sensor 203*b*, and that between the liquid-side temperature sensor 204*a* and the liquid-side temperature sensor 204*b* are also reversed.

When it is determined that the ending conditions are satisfied, the routine is ended once to end the simultaneous heating and defrosting operation mode (YES in STEP 20).

<Action>

In the air-conditioning apparatus 100 according to Embodiment 1, the simultaneous heating and defrosting operation mode can be achieved. Therefore, the outdoor heat exchanger 3 on the outdoor side can be defrosted without stopping the heating operation on the indoor side. At this time, it is possible to prevent a blowing temperature on the indoor side and the room temperature from being reduced by the defrosting operation and thus prevent the comfort from being reduce. By contrast, these problems unavoidably arise during the heating operation of existing air-conditioning apparatuses.

In the air-conditioning apparatus 100 according to Embodiment 1, the initial control target values of the actuators of the refrigerant circuit in the simultaneous heating and defrosting operation mode are set based on the air-conditioning load state and the operation state that are detected immediately before the operation mode is switched from the heating operation mode to the simultaneous heating and defrosting operation mode, and the control of the actuators is performed. Because of the above configuration, it is possible to appropriately control the actuators, depending on a change in the operation state that is made when the operation mode is switched from the heating operation mode to the simultaneous heating and defrosting operation mode. Therefore, it is possible to maintain the heating capacity before and after the operation mode is switched from the heating operation mode to the simultaneous heating and defrosting operation mode, to avoid a decrease in the indoor temperature, and to ensure a high defrosting capacity in the simultaneous heating and defrosting operation mode.

In the air-conditioning apparatus 100 according to Embodiment 1, the first outdoor fan 4*a* and the second outdoor fan 4*b* are individually controlled in the simultaneous heating and defrosting operation mode. Thus, it is possible to prevent the heating capacity from being reduced by the following cause: when outside air is sucked to one of the first parallel outdoor heat exchanger 3*a* and the second parallel outdoor heat exchanger 3*b*, which is the defrosting target, from the other of the first parallel outdoor heat exchanger 3*a* and the second parallel outdoor heat exchanger 3*b*, which is not the defrosting target, the air volume in the above other outdoor heat exchanger that is not the defrosting target is reduced. Also, it is possible to prevent the defrosting capacity from being reduced by a heat loss that occurs when heat is transferred from defrosting refrigerant to outside air at the above outdoor heat exchanger that is the defrosting target, under a condition in which the outside air temperature is low.

In the air-conditioning apparatus 100 according to Embodiment 1, in the simultaneous heating and defrosting operation mode, the control value of one of the first outdoor fan 4*a* and the second outdoor fan 4*b* that is an outdoor fan on the defrosting target side is changed depending on the outside air temperature. Thus, when the outside air temperature is low, it is possible to prevent the defrosting capacity from being reduced by a heat loss that occurs when heat is transferred from the defrosting refrigerant to outside air. Furthermore, when the outside air temperature is relatively high, for example, when the outside air temperature is higher than the temperature of defrosting refrigerant, heat collected from outside air can be used for defrosting heat quantity, and a high defrosting capacity can thus be achieved.

In the air-conditioning apparatus 100 according to Embodiment 1, in the simultaneous heating and defrosting operation mode, the control value of at least one of the defrosting refrigerant pressure-reducing device 14 and the compressor 1 is changed depending on an air-conditioning load state on the indoor side. It is therefore possible to appropriately adjust the heating capacity, depending on the change of the air-conditioning load state on the indoor side, and thus prevent the indoor temperature from excessively rising or dropping in the heating operation.

<Advantageous Effects of Embodiment 1>

According to Embodiment 1, the air-conditioning apparatus 100 includes the main circuit in which the compressor 1, the cooling/heating switching device 2, the indoor heat exchanger 7, the pressure reducing device 5*a*, the pressure reducing device 5*b*, the first parallel outdoor heat exchanger 3*a*, and the second parallel outdoor heat exchanger 3*b* are connected by the refrigerant pipes. The air-conditioning apparatus 100 includes the bypass circuit that extends through the defrosting refrigerant pressure-reducing device 14, the defrosting flow passage switching device 15*a*, the defrosting flow passage switching device 15*b*, and the backflow prevention device 16. The defrosting refrigerant pressure-reducing device 14 reduces the pressure of refrigerant that branches off from the main circuit, by adjusting the flow rate of the refrigerant in the refrigerant pipe that branches off from the discharge pipe of the compressor 1. The defrosting flow passage switching device 15*a* switches the flow passage for refrigerant that is supplied to the first parallel outdoor heat exchanger 3*a*. The defrosting flow passage switching device 15*b* switches the flow passage for refrigerant that is supplied to the second parallel outdoor heat exchanger 3*b*. The backflow prevention device 16 is provided between the defrosting flow passage switching devices 15*a* and 15*b* and the cooling/heating switching device 2 to prevent the backflow of low-pressure refrigerant that flows to the suction side of the compressor 1. The bypass circuit is connected by pipes to the first parallel outdoor heat exchanger 3*a* and the second parallel outdoor heat exchanger 3*b*. The bypass circuit causes part of refrigerant discharged from the compressor 1 to branch off from the discharged refrigerant; switches the flow passage for introduction of refrigerant, using the defrosting flow passage switching device 15*a* and the defrosting flow passage switching device 15*b*, to select one of the first parallel outdoor heat exchanger 3*a* and the second parallel outdoor heat exchanger 3*b* as the defrosting target; and supplies defrosting refrigerant the pressure of which is reduced by the defrosting refrigerant pressure-reducing device 14 to the defrosting target. The refrigerant circuit of the air-conditioning apparatus 100 includes the main circuit and the bypass circuit. The air-conditioning apparatus 100 includes the air-conditioning load state detection unit that detects an air-conditioning load state. The air-conditioning apparatus 100 includes the operation-state detection unit that detects the operation state of the refrigerant circuit. The air-conditioning apparatus 100 includes the controller 30 that individually controls the operations of the compressor 1, the pressure reducing device 5*a* and the pressure reducing device 5*b*, the defrosting refrigerant pressure-reducing device 14, and the defrosting flow passage switching device 15*a* and the defrosting flow passage switching device 15*b*. The air-conditioning apparatus 100 has the simultaneous heating and defrosting operation mode in which the heating operation and the defrosting operation are simultaneously performed such that while the heating operation is continued on the indoor side, defrosting refrigerant is made to flow through the bypass circuit on the outdoor side to alternately defrost the first parallel outdoor heat exchanger 3*a* and the second parallel outdoor heat exchanger 3*b*. In the simultaneous heating and defrosting operation mode, the controller 30 controls the compressor 1, the pressure reducing device 5*a*, the pressure reducing device 5*b*, and the defrosting refrigerant pressure-reducing device 14 such that the control amounts of these actuators reach respective normal-time control target values that are set based on the air-conditioning load state and the operation state.

In the above configuration, it is possible to achieve the simultaneous heating and defrosting operation mode that uses a feedback control based on the air-conditioning load state and the operation state. Therefore, in the simultaneous heating and defrosting operation mode, it is possible to maintain the comfort, whiling ensuring the reliability. To be more specific, the comfort is maintained by maintaining the heating capacity before and after the operation mode is switched from the heating operation mode to the simultaneous heating and defrosting operation mode, and the reliability is ensured by ensuring an appropriate defrosting capacity for the simultaneous heating and defrosting operation mode.

According to Embodiment 1, based on the air-conditioning load state and the operation state that are detected immediately before the operation mode is switched from the heating operation mode to the simultaneous heating and defrosting operation mode, the controller 30 sets the initial control target values of the compressor 1, the pressure reducing device 5*a*, the pressure reducing device 5*b*, and the defrosting refrigerant pressure-reducing device 14 for the simultaneous heating and defrosting operation mode. At the time of starting the simultaneous heating and defrosting operation mode, the controller 30 controls the compressor 1, the pressure reducing device 5*a*, the pressure reducing device 5*b*, and the defrosting refrigerant pressure-reducing device 14 such that the control amounts of these actuators reach the respective initial control target values.

Because of provision of the above configuration, it is possible to start the simultaneous heating and defrosting operation mode that uses the feedforward control based on the air-conditioning load state and the operation state that are detected immediately before the operation mode is switched from the heating operation mode to the simultaneous heating and defrosting operation mode. Therefore, at the time of starting the simultaneous heating and defrosting operation mode, it is possible to maintain the comfort by maintaining the heating capacity before and after switching the operation mode from the heating operation mode to the simultaneous heating and defrosting operation mode, while ensuring the reliability by ensuring an appropriate defrosting capacity for the simultaneous heating and defrosting operation mode.

According to Embodiment 1, after the control amounts of the compressor 1, the pressure reducing device 5*a*, the pressure reducing device 5*b*, and the defrosting refrigerant pressure-reducing device 14 reach the respective initial control target values, the controller 30 controls the pressure reducing device 5*a*, the pressure reducing device 5*b*, and the defrosting refrigerant pressure-reducing device 14 such that the control amounts of the pressure reducing device 5*a*, the pressure reducing device 5*b*, and the defrosting refrigerant pressure-reducing device 14 reach the respective normal-time control target values.

With the above configuration, it is possible to start the simultaneous heating and defrosting operation mode that uses the feedforward control based on the air-conditioning load state and the operation state that are detected immediately before switching the operation mode from the heating operation mode to the simultaneous heating and defrosting operation mode. Thereafter, it is possible to achieve the simultaneous heating and defrosting operation mode that uses the feedback control based on the air-conditioning load state and the operation state. Therefore, in the simultaneous heating and defrosting operation mode, it is possible to maintain the comfort by maintaining the heating capacity before and after switching the operation mode from the heating operation mode to the simultaneous heating and defrosting operation mode, while ensuring the reliability by ensuring the appropriate defrosting capacity for the simultaneous heating and defrosting operation mode.

According to Embodiment 1, the first outdoor fan 4*a* and the second outdoor fan 4*b* are provided. The first outdoor fan 4*a* and the second outdoor fan 4*b* send outside air for use in heat exchange with refrigerant to the first parallel outdoor heat exchanger 3*a* and the second parallel outdoor heat exchanger 3*b*, respectively. In the simultaneous heating and defrosting operation mode, the controller 30 individually controls the operations of the first outdoor fan 4*a* and the second outdoor fan 4*b*.

With the above configuration, it is possible to prevent the heating capacity from being reduced by the following cause: when air is sucked to one of the first parallel outdoor heat exchanger 3*a* and the second parallel outdoor heat exchanger 3*b*, which is the defrosting target, from the other of the first parallel outdoor heat exchanger 3*a* and the second parallel outdoor heat exchanger 3*b*, which is not the defrosting target, the air volume in the above other outdoor heat exchanger that is not the defrosting target is reduced. Also, it is possible to prevent the defrosting capacity from being reduced by a heat loss that occurs when heat is transferred from defrosting refrigerant to outside air at the above outdoor heat exchanger that is the defrosting target, under a condition in which the outside air temperature is low.

According to Embodiment 1, the air-conditioning load state detection unit includes the outside air temperature sensor 203*a* and the outside air temperature sensor 203*b* that detect the outside air temperature. Based on detection values obtained by detection performed by the outside air temperature sensor 203*a* and the outside air temperature sensor 203*b* that are performed immediately before the operation mode is switched from the heating operation mode to the simultaneous heating and defrosting operation mode, the controller 30 controls in the simultaneous heating and defrosting operation mode, the control amount of the first outdoor fan 4*a* or the second outdoor fan 4*b* for the heat exchanger that is the defrosting target, such that when the outside air temperature is lower than a predetermined value, the first outdoor fan 4*a* or the second outdoor fan 4*b* is stopped or the rotation speed of the first outdoor fan 4*a* or the second outdoor fan 4*b* is reduced to the minimum value, and when the outside air temperature is higher than the predetermined value, the current value is maintained or a rotation speed is increased to the maximum value.

With the above configuration, when the outside air temperature is low, it is possible to prevent the defrosting capacity from being reduced by a heat loss that occurs when heat is transferred from the defrosting refrigerant to outside air. Furthermore, under a condition where the outside air temperature is relatively high, such as a condition where the outside air temperature is higher than the temperature of defrosting refrigerant, heat collected from outside air can be used for defrosting heat quantity and a high defrosting capacity can thus be achieved.

According to Embodiment 1, in the simultaneous heating and defrosting operation mode, the controller 30 controls the first outdoor fan 4*a* or the second outdoor fan 4*b* for the heat exchanger that is the defrosting target, such that the control amount of the first outdoor fan 4*a* or the second outdoor fan 4*b* reaches a normal-time control target value that is set based on the outside air temperature. The normal-time control target value of the first outdoor fan 4*a* or the second outdoor fan 4*b* for the heat exchanger that is the defrosting target is a target value that is required to cause the first outdoor fan 4*a* or the second outdoor fan 4*b* to be stopped or the rotation speed of the first outdoor fan 4*a* or the second outdoor fan 4*b* to be reduced to the minimum value when the outside air temperature becomes less than or equal to a predetermined value in the simultaneous heating and defrosting operation mode, and that is required to cause the rotational speed of the first outdoor fan 4*a* or the second outdoor fan 4*b* to be increased to the rotational speed in the heating operation that is applied before the operation mode is switched from the heating operation mode to the simultaneous heating and defrosting operation mode, or to be increased to the maximum value, when the outside air temperature is higher than a predetermined value during the simultaneous heating and defrosting operation mode.

With the above configuration, it is possible to prevent the defrosting capacity from being reduced by a heat loss that occurs when heat is transferred from defrosting refrigerant to outside air at one of the heat exchangers that is the defrosting target, under a condition in which the outside air temperature is low.

According to Embodiment 1, in the simultaneous heating and defrosting operation mode, the controller 30 controls the control amount of the first outdoor fan 4*a* or the second outdoor fan 4*b* for the heat exchanger that is not the defrosting target such that the current value is maintained or the rotation speed of the first outdoor fan 4*a* or the second outdoor fan 4*b* is increased to the maximum value.

With the above configuration, it is possible to prevent the heating capacity from being reduced the following cause: when air is sucked to one of the first parallel outdoor heat exchanger 3*a* and the second parallel outdoor heat exchanger 3*b*, which is the defrosting target, from the other of the first parallel outdoor heat exchanger 3*a* and the second parallel outdoor heat exchanger 3*b*, which is not the defrosting target, the air volume in the above other outdoor heat exchanger that is not the defrosting target is reduced.

According to Embodiment 1, the air-conditioning load state detection unit is an indoor load state detection unit that detects the deviation of the indoor air temperature from the set air-conditioning temperature. During the simultaneous heating and defrosting operation mode, the controller 30 sets the normal-time control target value in such a manner as to adjust the control amount of at least one of the opening degree of the defrosting refrigerant pressure-reducing device 14 and the operating frequency of the compressor 1 based on the value of the deviation detected by the indoor load state detection unit.

With the above configuration, it is possible to appropriately adjust the heating capacity, depending on the change of the air-conditioning load state on the indoor side, and prevent the indoor temperature from being excessively raised or reduced during the heating operation.

According to Embodiment 1, the main circuit includes the first bypass pipe 21 that branches off from the refrigerant pipe extending from the compressor 1 through the indoor heat exchanger 7, as an injection flow passage for use in injection of refrigerant that branches off from the main circuit into the compressor 1. The main circuit includes the injection refrigerant pressure-reducing device 5*c* that reduces the pressure of refrigerant by adjusting the flow rate of the refrigerant in the first bypass pipe 21. The controller 30 opens the injection refrigerant pressure-reducing device 5*c* in the simultaneous heating and defrosting operation mode.

With the above configuration, in the simultaneous heating and defrosting operation mode, the amount of refrigerant that is supplied to the compressor 1 can be increased, and defrosting on the outdoor side can be achieved without stopping the heating operation on the indoor side. Therefore, even when the defrosting operation is performed simultaneously, the amount of refrigerant that is supplied from the compressor 1 to the indoor side can be compensated for, and it is possible to prevent a blowing temperature on the indoor side and the room temperature from being reduced by the defrosting operation, and thus prevent the comfort from being reduced. By contrast, in existing air-conditioning apparatuses, these problems unavoidably arise during the heating operation.

According to Embodiment 1, regarding the injection refrigerant pressure-reducing device 5*c*, the controller 30 sets the initial control target value in the simultaneous heating and defrosting operation mode at the point of time immediately after the operation mode is switched from the heating operation mode to the simultaneous heating and defrosting operation mode. In the case where the injection refrigerant pressure-reducing device 5*c* is in the fully closed state immediately before the switching of the operation mode, the initial control target value of the injection refrigerant pressure-reducing device 5*c* is set to an opening degree corresponding to the fully opened state or a predetermined opening degree. In contrast, in the case where the injection refrigerant pressure-reducing device 5*c* is not in the fully closed state immediately before the switching of the operation mode, the opening degree of the injection refrigerant pressure-reducing device 5*c* in the heating operation is maintained.

With the above configuration, when the operation mode is switched from the heating operation mode to the simultaneous heating and defrosting operation mode, it is possible to start the simultaneous heating and defrosting operation mode that uses a feedforward control in which the injection refrigerant pressure-reducing device 5*c* is opened. Therefore, in the simultaneous heating and defrosting operation mode, the amount of refrigerant that is supplied to the compressor 1 can be increased, and defrosting on the outdoor side can be achieved without stopping the heating operation on the indoor side. Thus, even when the defrosting operation is performed simultaneously, the amount of refrigerant that is supplied from the compressor 1 to the indoor side can be compensated for, and it is possible to prevent a blowing temperature on the indoor side and the room temperature from being reduced by the defrosting operation, and thus prevent the comfort from being reduced. By contrast, these problems unavoidably arise during the heating operation of the existing air-conditioning apparatuses.

According to Embodiment 1, in the case where the opening degree of the injection refrigerant pressure-reducing device 5*c* reaches the initial control target value of the injection refrigerant pressure-reducing device 5*c*, the controller 30 sets the normal-time control target value of the pressure reducing device 5*a* to an opening degree that is required to cause the degree of superheat of refrigerant discharged from the compressor 1 to reach a predetermined value, and the normal-time control target value of the injection refrigerant pressure-reducing device 5*c* is kept at the initial control target value of the injection refrigerant pressure-reducing device 5*c*.

With the above configuration, in the simultaneous heating and defrosting operation mode, the amount of refrigerant that is supplied to the compressor 1 can be increased, and defrosting on the outdoor side can be achieved without stopping the heating operation on the indoor side. Furthermore, it is possible to prevent an excessive liquid back that would be caused by excessive inflow of liquid refrigerant into the compressor 1. It is therefore possible to avoid occurrence of a failure at the compressor 1, and ensure reliability of the air-conditioning apparatus 100.

According to Embodiment 1, in the case where the opening degree of the injection refrigerant pressure-reducing device 5*c* reaches the initial control target value of the injection refrigerant pressure-reducing device 5*c*, the controller 30 sets the normal-time control target value of the injection refrigerant pressure-reducing device 5*c* to an opening degree that is required to cause that the degree of superheat of refrigerant discharged from the compressor 1 to reach a predetermined value, and the controller 30 sets the normal-time control target value of the pressure reducing device 5*a* to an opening degree that is required to cause the degree of superheat of refrigerant sucked into the compressor 1 to reach a predetermined value.

With the above configuration, in the simultaneous heating and defrosting operation mode, the amount of refrigerant that is supplied to the compressor 1 can be increased, and defrosting on the outdoor side can be achieved without stopping the heating operation on the indoor side. Furthermore, it is possible to prevent an excessive liquid back that would be caused by an excessive inflow of liquid refrigerant into the compressor 1. Therefore, it is possible to avoid occurrence of a failure at the compressor 1, and thus ensure reliability of the air-conditioning apparatus 100.

According to Embodiment 1, the first parallel outdoor heat exchanger 3*a* and the second parallel outdoor heat exchanger 3*b* are housed in the housing of the heat source unit such that the plurality of heat exchangers are stacked together in the vertical direction.

With the above configuration, the first parallel outdoor heat exchanger 3*a* and the second parallel outdoor heat exchanger 3*b* can be mounted in a small region in the housing of the heat source unit A.

<Modification of Air-Conditioning Apparatus 100>

Although the configuration of the flow passages, such as the connection of refrigerant pipes, and the configuration or arrangement of components in the refrigerant circuit, such as the compressor 1, various heat exchangers, and various pressure reducing devices are described above, their descriptions are not limiting, and may be appropriately changed without departing from the technical scope of the present disclosure.

REFERENCE SIGNS LIST

1 compressor, 2 cooling/heating switching device, 3 outdoor heat exchanger, 3*a* first parallel outdoor heat exchanger, 3*b* second parallel outdoor heat exchanger, 4*a* first outdoor fan, 4*b* second outdoor fan, 5*a* pressure reducing device, 5*b* pressure reducing device, 5*c* injection refrigerant pressure-reducing device, 6 liquid connection pipe, 7 indoor heat exchanger, indoor fan, 9 gas connection pipe, 11 receiver, 13 internal heat exchanger, 14 defrosting refrigerant pressure-reducing device, 15*a* defrosting flow passage switching device, 15*b* defrosting flow passage switching device, 16 backflow prevention device, 21 first bypass pipe, 22 second bypass pipe, 30 controller, 30*a* measuring unit, 30*b* computation unit, 30*c* driving unit, 30*d* storage unit, 30*e* determining unit, 41 first connection pipe, 42 second connection pipe, 100 air-conditioning apparatus, 201 discharge temperature sensor, 202*a* gas-side temperature sensor, 202*b* gas-side temperature sensor, 203*a* outside air temperature sensor, 203*b* outside air temperature sensor, 204*a* liquid-side temperature sensor, 204*b* liquid-side temperature sensor, 205 liquid-side temperature sensor, 206 indoor temperature sensor, 207 gas-side temperature sensor, 208 shell temperature sensor, A heat source unit, B use unit

The invention claimed is:

1. An air-conditioning apparatus comprising:

a refrigerant circuit including a main circuit in which a compressor, a cooling/heating switching device, an indoor heat exchanger, a pressure reducing device, and parallel outdoor heat exchangers are connected by refrigerant pipes, and a bypass circuit connected, by a pipe, to each of the parallel outdoor heat exchangers via a defrosting refrigerant pressure-reducing device, a defrosting flow passage switching device, and a backflow prevention device, the defrosting refrigerant pressure-reducing device being configured to reduce a pressure of refrigerant that branches off from the main circuit, by adjusting a flow rate of the refrigerant in a refrigerant pipe that branches off from a discharge pipe at the compressor, the defrosting flow passage switching device being configured to switch a flow passage for refrigerant that is supplied to one of the parallel outdoor heat exchangers, the backflow prevention device being provided between the defrosting flow passage switching device and the cooling/heating switching device to prevent backflow of low-pressure refrigerant that flows to a suction side of the compressor, the bypass circuit being configured to: cause part of refrigerant discharged from the compressor to branch off from the discharged refrigerant; switch a flow passage for use in introduction of refrigerant, using the defrosting flow passage switching device, to select one of the parallel outdoor heat exchangers as a defrosting target to be defrosted; and supply defrosting refrigerant whose pressure is reduced by the defrosting refrigerant pressure-reducing device to the defrosting target;

an air-conditioning load state detection unit configured to detect an air-conditioning load state;

an operation-state detection unit configured to detect an operation state of the refrigerant circuit; and a controller configured to individually control operations of the compressor, the pressure reducing device, the defrosting refrigerant pressure-reducing device, and the defrosting flow passage switching device, wherein the air-conditioning apparatus has a simultaneous heating and defrosting operation mode in which a heating operation and a defrosting operation are simultaneously performed such that while the heating operation is continued on an indoor side, the defrosting refrigerant is made to flow in the bypass circuit on an outdoor side to alternately defrost the parallel outdoor heat exchangers, and in the simultaneous heating and defrosting operation mode, the controller controls the compressor, the pressure reducing device, and the defrosting refrigerant pressure-reducing device such that control amounts of the compressor, the pressure reducing device, and the defrosting refrigerant pressure-reducing device reach respective normal-time control target values set based on the air-conditioning load state and the operation state.

2. The air-conditioning apparatus of claim 1, wherein the controller sets initial control target values of the compressor, the pressure reducing device, and the defrosting refrigerant pressure-reducing device based on the air-conditioning load state and the operation state detected immediately before an operation mode is switched from a heating operation mode to the simultaneous heating and defrosting operation mode, and at time of starting the simultaneous heating and defrosting operation mode, the controller controls the compressor, the pressure reducing device, and the defrosting refrigerant pressure-reducing device such that the control amounts of the compressor, the pressure reducing device, and the defrosting refrigerant pressure-reducing device reach the respective initial control target values.

3. The air-conditioning apparatus of claim 2, wherein after the control amounts of the compressor, the pressure reducing device, and the defrosting refrigerant pressure-reducing device reach the respective initial control target values, the controller controls the pressure reducing device and the defrosting refrigerant pressure-reducing device such that the control amounts of the pressure reducing device and the defrosting refrigerant pressure-reducing device reach the respective normal-time control target values.

4. The air-conditioning apparatus of claim 1, further comprising a plurality of outdoor fans each configured to send outside air for use in heat exchange with refrigerant to an associated one of the parallel outdoor heat exchangers, wherein the controller individually controls operations of the plurality of outdoor fans in the simultaneous heating and defrosting operation mode.

5. The air-conditioning apparatus of claim 4, wherein the air-conditioning load state detection unit is an outside-air temperature detection unit configured to detect an outside air temperature, and based on a detection value obtained by detection that is performed by the outside-air temperature detection unit immediately before the operation mode is switched from a heating operation mode to the simultaneous heating and defrosting operation mode, the controller controls in the simultaneous heating and defrosting operation mode, a control amount of one of the plurality of outdoor fans that is associated with one of the parallel outdoor heat exchangers that is a defrosting target, such that when an outside air temperature is less than a predetermined value, the associated outdoor fan is stopped or a rotation speed of the associated outdoor fan is reduced to a minimum value, and when the outside air temperature is higher than the predetermined value, a current value is maintained or the rotation speed of the associated outdoor fan is increased to a maximum value.

6. The air-conditioning apparatus of claim 5, wherein in the simultaneous heating and defrosting operation mode, the controller controls the associated outdoor fan for the parallel outdoor heat exchanger that is the defrosting target such that a control amount of the associated outdoor fan reaches a normal-time control target value set based on the outside air temperature, and the normal-time control target value of the associated outdoor fan for the parallel outdoor heat exchanger that is the defrosting target is a target value that is required to cause the outdoor fan to be stopped or the rotation speed of the outdoor fan to be reduced to the minimum value, when the outside air temperature is less than or equal to the predetermined value in the simultaneous heating and defrosting operation mode, and that is required to cause the rotational speed of the outdoor fan to be increased to a rotational speed of the outdoor fan during a heating operation that is performed before the operation mode is switched from the heating operation mode to the simultaneous heating and defrosting operation mode, or to be increased to the maximum value, when the outside air temperature is higher than the predetermined value in the simultaneous heating and defrosting operation mode.

7. The air-conditioning apparatus of claim 4, wherein in the simultaneous heating and defrosting operation mode, the controller controls a control amount of one of the plurality of outdoor fans that is associated with one of the parallel outdoor heat exchangers that is not the defrosting target, such that a current value is maintained, or a rotation speed of the associated outdoor fan is increased to a maximum value.

8. The air-conditioning apparatus of claim 1, wherein the air-conditioning load state detection unit is an indoor load state detection unit that detects a deviation of an indoor air temperature from a set air-conditioning temperature, and in the simultaneous heating and defrosting operation mode, the controller sets a control target value to adjust a control amount of at least one of an opening degree of the defrosting refrigerant pressure-reducing device and an operating frequency of the compressor based on a value of the deviation detected by the indoor load state detection unit.

9. The air-conditioning apparatus of claim 1, wherein the main circuit includes an injection flow passage and an injection refrigerant pressure-reducing device, the injection flow passage branching off from the refrigerant pipe that extends from the compressor through the indoor heat exchanger to inject refrigerant that branches off from the main circuit into the compressor, the injection refrigerant pressure-reducing device being configured to adjust a flow rate of the refrigerant in the injection flow passage to reduce a pressure of the refrigerant, and the controller opens the injection refrigerant pressure-reducing device in the simultaneous heating and defrosting operation mode.

10. The air-conditioning apparatus of claim 9, wherein the controller sets an initial control target value of the injection refrigerant pressure-reducing device in the simultaneous heating and defrosting operation mode at a point of time immediately after an operation mode is switched from a heating operation mode to the simultaneous heating and defrosting operation mode, and when the injection refrigerant pressure-reducing device is in a fully closed state immediately before the operation mode is switched, the initial control target value of the injection refrigerant pressure-reducing device is set to a value corresponding to a fully opened state or a predetermined opening degree of the injection refrigerant pressure-reducing device, and when the injection refrigerant pressure-reducing device is not in the fully closed state immediately before the operation mode is switched, the initial control target value of the injection refrigerant pressure-reducing device is kept at a value corresponding to an opening degree of the injection refrigerant pressure-reducing device in the heating operation.

11. The air-conditioning apparatus of claim 10, wherein when the opening degree of the injection refrigerant pressure-reducing device reaches the initial control target value, the controller sets a normal-time control target value of the pressure reducing device to an opening degree that is required to cause a degree of superheat of refrigerant discharged from the compressor to reach a predetermined value, and the controller keeps a normal-time control target value of the injection refrigerant pressure-reducing device at the initial control target value of the injection refrigerant pressure-reducing device.

12. The air-conditioning apparatus of claim 10, wherein when the opening degree of the injection refrigerant pressure-reducing device reaches the initial control target value, the controller sets a normal-time control target value of the injection refrigerant pressure-reducing device to an opening degree that is required to cause a degree of superheat of refrigerant discharged from the compressor to reach a predetermined value, and the controller sets a normal-time control target value of the pressure reducing device to an opening degree that is required to cause a degree of superheat of refrigerant sucked into the compressor to reach a predetermined value.

13. The air-conditioning apparatus of claim 1, wherein the parallel outdoor heat exchangers are housed in a housing such that a plurality of heat exchangers are stacked together in a vertical direction.

* * * * *